US011424094B2

(12) United States Patent
Yamaguchi et al.

(10) Patent No.: US 11,424,094 B2
(45) Date of Patent: Aug. 23, 2022

(54) FUSIBLE LINK UNIT

(71) Applicant: Yazaki Corporation, Tokyo (JP)

(72) Inventors: Makoto Yamaguchi, Shizuoka (JP); Ryu Okada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/540,996

(22) Filed: Dec. 2, 2021

(65) Prior Publication Data

US 2022/0181110 A1 Jun. 9, 2022

(30) Foreign Application Priority Data

Dec. 4, 2020 (JP) ..... JP2020-201593

(51) Int. Cl.
*H01H 85/22* (2006.01)
*H01H 85/055* (2006.01)
*H01H 85/20* (2006.01)

(52) U.S. Cl.
CPC ..... *H01H 85/055* (2013.01); *H01H 85/2045* (2013.01); *H01H 85/22* (2013.01); *H01H 2085/2075* (2013.01)

(58) Field of Classification Search
CPC .. H01H 85/055; H01H 85/2045; H01H 85/22; H01H 2085/2075; H01H 2085/208
See application file for complete search history.

(56) References Cited

U.S. PATENT DOCUMENTS

2002/0134572 A1* 9/2002 Matsumura ..... H01H 85/044 174/66
2002/0163416 A1* 11/2002 Matsumura ..... H01H 85/044 337/112
2012/0309239 A1* 12/2012 Onoda ..... H01R 11/284 439/766
2016/0203935 A1* 7/2016 Onoda ..... H01M 50/572 337/1
2016/0203936 A1* 7/2016 Onoda ..... H01H 85/2045 439/620.26
2017/0032919 A1* 2/2017 Yamaguchi ..... H01H 85/0241
2017/0345601 A1* 11/2017 Kitano ..... H01M 50/581
2018/0047538 A1* 2/2018 Ohashi ..... H01H 85/0241

FOREIGN PATENT DOCUMENTS

JP 2009-076408 A 4/2009
JP 2017-4872 A 1/2017

* cited by examiner

*Primary Examiner* — Jacob R Crum
(74) *Attorney, Agent, or Firm* — Sughrue Mion, PLLC

(57) ABSTRACT

A fusible link unit includes a locking member having a first locked portion, a second locked portion, and a pair of first abutted portions; a connection section; a first body having a first locking part and a pair of first abutting parts, the first body being extended from the first boundary in a predetermined direction, and the first boundary being a boundary extending in a direction that intersects a deployed direction of the first abutting parts; and a second body having a second locking part and a pair of second abutting parts, and extending in the same direction as the first body from the second boundary, the second boundary being a boundary extending in a direction that intersects a deployed direction of the second abutting part.

8 Claims, 16 Drawing Sheets

FUSIBLE LINK UNIT

CROSS REFERENCE TO RELATED APPLICATION

The present application is based on, and claims priority from the prior Japanese Patent Application No. 2020-201593, filed on Dec. 4, 2020, the entire contents of which are incorporated herein by reference.

TECHNICAL FIELD

The present disclosure relates to a fusible link unit.

BACKGROUND

Conventionally, a fusible link unit employing a foldable structure is known (see JP 2009-76408 A).

The conventional fusible link unit includes a first body, a second body, and a connection section (circuit body connection section). A bus bar is bent at a boundary between the first body and the connecting section and a boundary between the second body and the connecting section. Thus, the first body is configured to overlap with the second body and form a foldable structure. Since the conventional fusible link unit is formed in such structure, the expansion and enlargement of the heat radiation portion are prevented.

SUMMARY

In the conventional fusible link unit, as described above, the bus bar at the boundary between the first body and the connection section and the boundary between the second body and the connection section are bent. After the bus bar is bent, a shape holding is performed on the fusible link unit (holding of the foldable structure). In this shape holding state, a temporarily locked portion provided on the resin part of the first body is locked to the temporarily locking part provided on a resin part of the second body.

In the conventional fusible link unit, the shape holding is performed only by the temporarily locked portion of the first body made of resin and the temporarily locking part of the second body. Thus, when a torsional force is applied to the first body and the second body, the locking by the temporary locking part may be released. That is, when a torsional moment is applied, there is a possibility that the temporarily locked portion is detached from the temporarily locking part.

The present embodiment provides a fusible link unit having a foldable structure in which a first body does not easily come off from a second body even when a torsional force is applied to the foldable structure in a state in which the second body overlaps the first body.

A fusible link unit according to the present embodiment includes a locking member including a first locked portion, a second locked portion, and a pair of first abutted portions; a connection section; a first body including a first locking part configured to lock the first locked portion, and a pair of first abutting parts each of the pair of first abutting parts configured to abut a first part provided on each of the pair of first abutted portions, and extending in a predetermined direction from a first boundary, the first boundary being a boundary with the connection section and extending in a direction that intersects a deployed direction of at least one of the pair of first abutting parts; a second body comprising a second locking part configured to lock the second locked portion, and a pair of second abutting parts each of the pair of second abutting parts configured to abut a second part provided on each of the pair of first abutted portions, and extending in the same direction as the first body from a second boundary, the second boundary being a boundary with the connection section and extending in a direction that intersects a deployed direction of at least one of the pair of second abutting parts.

The locking member may be provided with a pair of second abutted portions. The first body may be provided with a third abutting part. The second body may be provided with a fourth abutting part. The fusible link unit may be configured to prevent the first body from being separated from the second body by abutting one of the pair of second abutted portions on the third abutting part, and abutting the other of the pair of second abutted portions on the fourth abutting part.

The locking member may be provided with a pair of third abutted portions. The first body may be provided with a fifth abutting part. The second body may be provided with a sixth abutting part. The fusible link unit may be configured to prevent the first body from approaching the second body by abutting one of the pair of third abutted portions (51) on the fifth abutting part (53), and abutting the other of the pair of third abutted portions (51) on the sixth abutting part (55).

The locking member may include a bottom wall, a pair of first sidewalls, and a pair of second sidewalls, and may be formed in a rectangular open-top-box structure. The pair of first abutting parts may include a pair of first abutting surfaces each of the first abutting surfaces being configured to abut the first part arranged on an outer surface of each of the pair of first sidewalls. The first boundary may extend in a direction orthogonal to the deployed direction of at least one of the pair of first abutting surfaces. The pair of second abutting parts may include a pair of second abutting surfaces each of the second abutting surfaces being configured to abut the second part arranged on the outer surface of each of the pair of first sidewalls. The second boundary may extend in parallel with the first boundary and may extend in a direction orthogonal to the deployed direction of at least one of the pair of second abutting surfaces.

The first locked portion and the second locked portion of the locking member may be provided on the bottom wall of the locking member and may be positioned inside between the pair of the first sidewalls and between the pair of the second sidewalls.

The bottom wall of the locking member may be provided with a through hole configured to release the first locked portion from being locked to the first locking part or to release the second locked portion from being locked to the second locking part.

The locking member may be provided with an installation detection part configured to detect whether the locking member is in a process of being installed in the first body and the second body or whether the locking member has been installed in the first body and the second body.

Each of the pair of second sidewalls may be provided with a projection projecting inward of the locking member. The first body may be provided with a recess into which the projection on one of the pair of second sidewalls of the locking member enters. The second body may be provided with a recess into which the projection on the other of the pair of second sidewalls of the locking member enters. In a state in which the locking member is in a process of being installed on the first body and the second body, each projection may be pushed by the first body and the second body, whereby each of the pair of second sidewalls may project outward. In a state in which the locking member has been installed on the first body and the second body, each projection may enter the recess of the first body or the recess of the second body, and each of the pair of second sidewalls may restore. The installation detection part may be configured of the pair of second sidewalls of the locking member which projects outward in a state in which the locking member is in a process of being installed on the first body and the second body and may restore the locking member in a state in which the locking member has been installed on the first body and the second body.

According to the configurations described above, the fusible link unit having a foldable structure, in which the first body does not easily come off from the second body even when a torsional force is applied to the foldable structure in a state in which the second body overlaps the first body, is provided.

DETAILED DESCRIPTION

Figure 1:
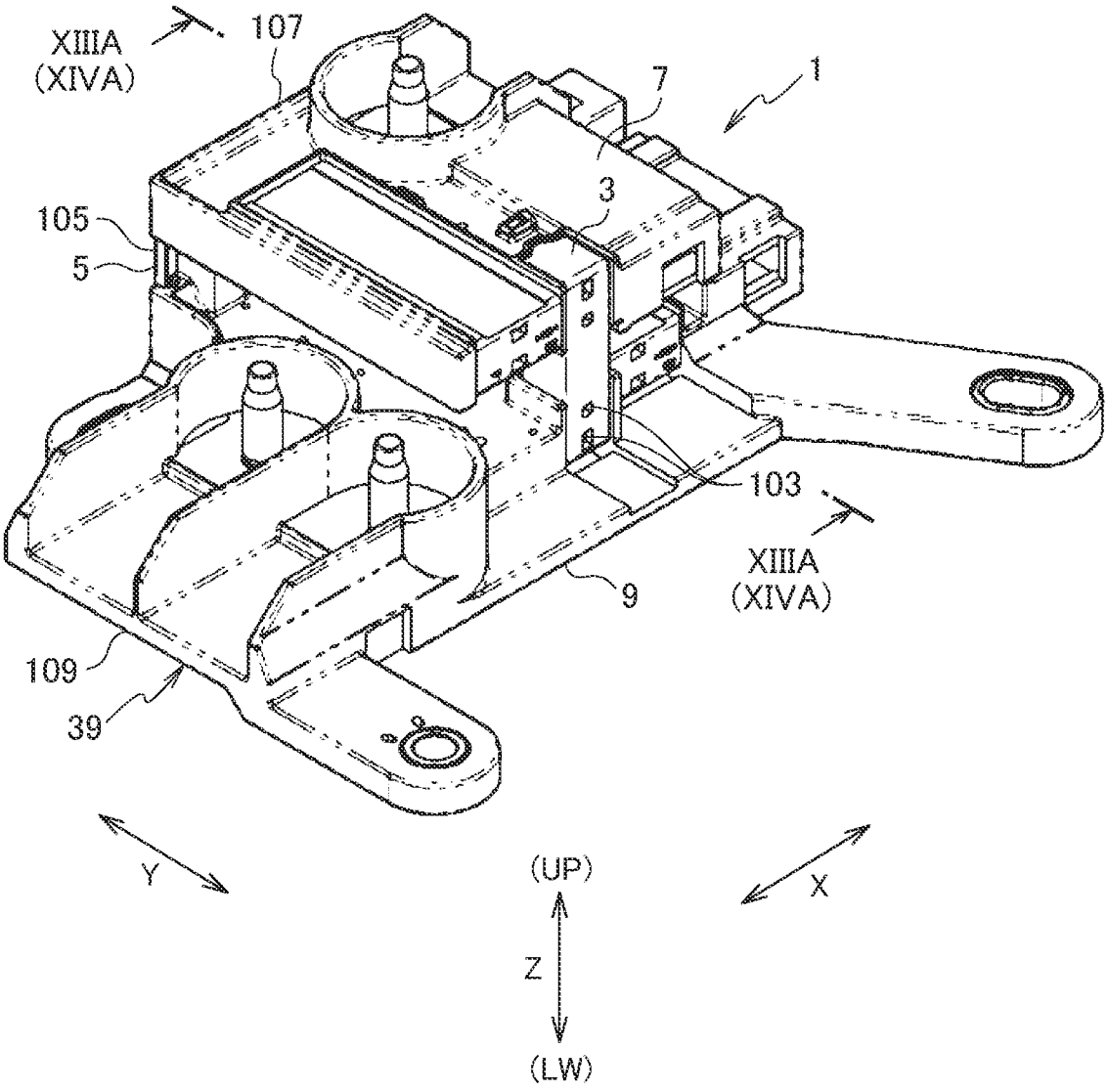
FIG. 1 is a perspective view of a fusible link unit according to one or more embodiments.

Various embodiments will be described hereinafter with reference to the accompanying drawings.

A fusible link unit 1 according to one or more embodiments is a fusible link unit installed and used in a vehicle (not shown), for example. As illustrated in FIGS. 1 to 4, the fusible link unit 1 includes a locking member 3, a connection section 5, a first body 7, and a second body 9.

For convenience of explanation. X direction is a predetermined direction in space. Y direction is a predetermined direction orthogonal to the X direction, and the Z direction is a direction orthogonal to the X direction and the Y direction. In FIG. 1 and the like, one side in the Z direction is an upper side UP and the other side in the Z direction is a lower side LW. However, the Z direction does not necessarily have to be a vertical direction, and the Z direction may be a horizontal direction or an oblique direction.

As illustrated in FIGS. 11A to 12D, the locking member 3 is provided with a first locked portion 11, a second locked portion 13, and a pair of first abutted portions 15. The pair of first abutted portions 15 are formed of, for example, a pair of planar first abutted surfaces 17 parallel to each other. As illustrated in FIGS. 3, 4, 9, and 10 and the like, the connection section 5 is formed, for example, in a flat plate shape.

Figure 5:
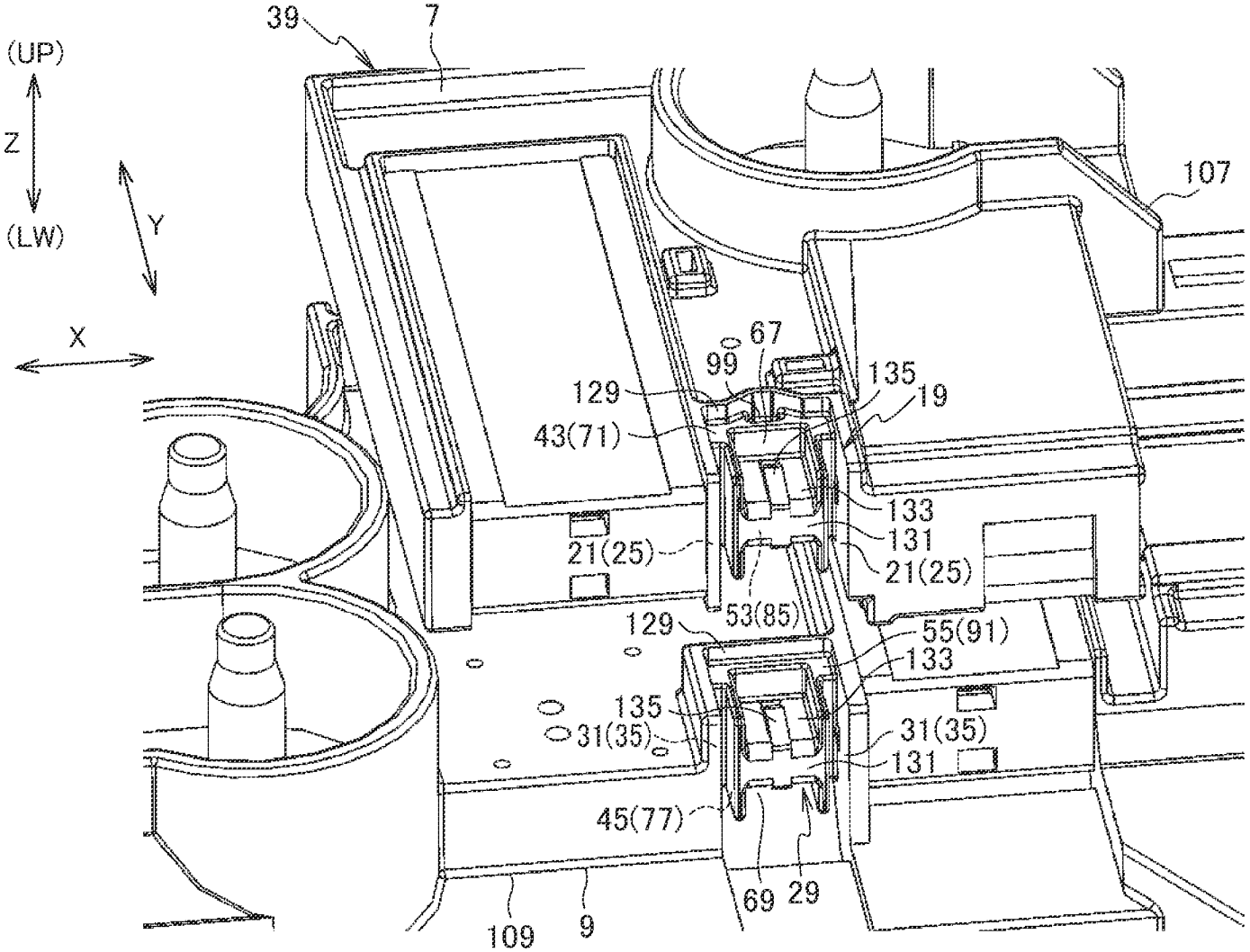
FIG. 5 is a perspective view of the fusible link unit body according to one or more embodiments mainly illustrating a position where the locking member is installed.
Figure 6:
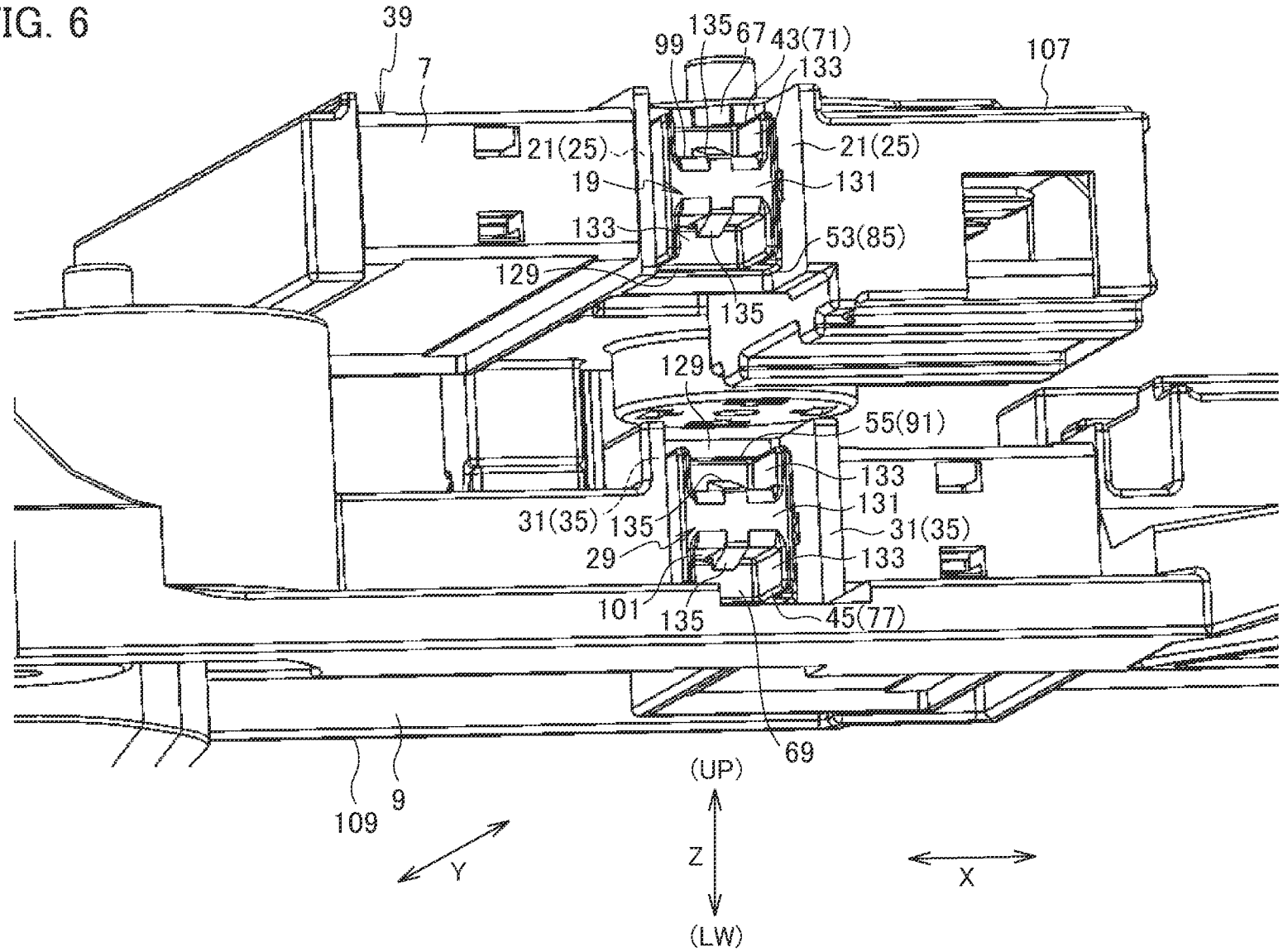
FIG. 6 is a perspective view similar to FIG. 5 in that the location where the locking member is installed is viewed from another angle.

As illustrated in FIGS. 5 and 6, the first body 7 is provided with a first locking part 19 and a pair of first abutting parts 21. The first locking part 19 is configured to lock the first locked portion 11 of the locking member 3. A part (first-abutted-portion first part) 23 on each of the pair of first abutted portions 15 of the locking member 3 is configured to be brought into surface contact with and to abut on each of the pair of first abutting parts 21. The pair of first abutting parts 21 are formed to be a pair of planar first abutting surfaces 25 parallel to each other, for example.

Figure 13A:
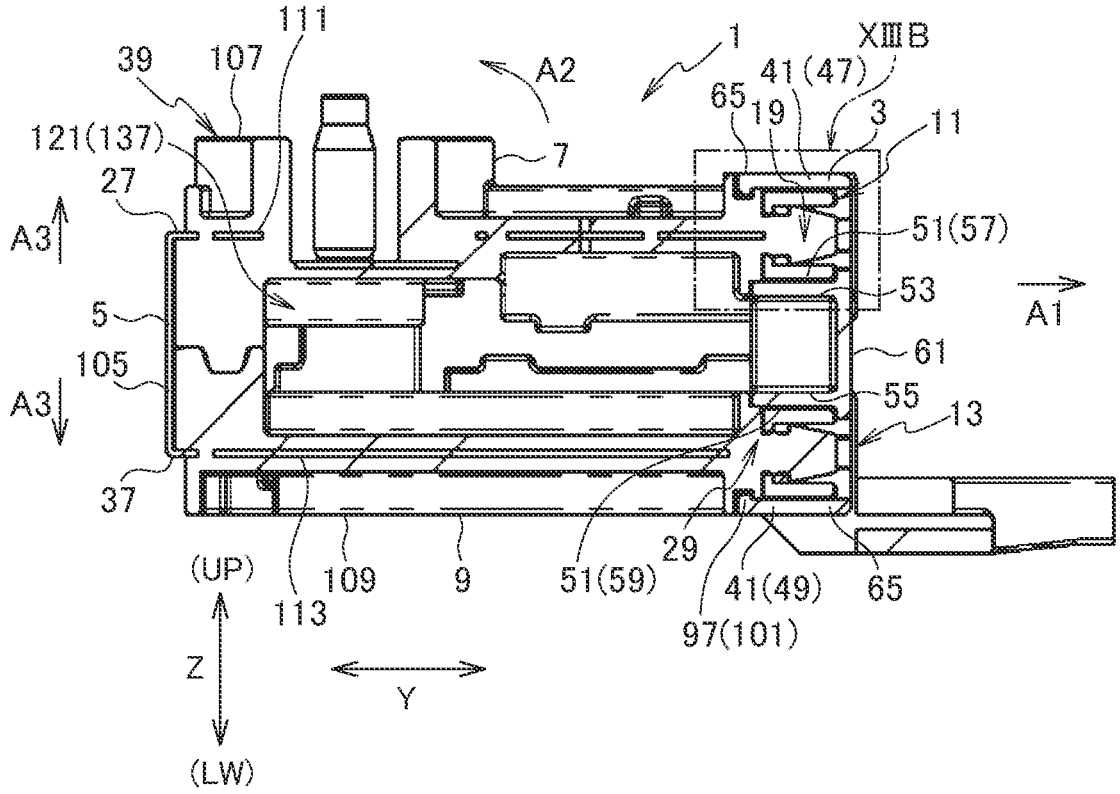
FIG. 13A is a view illustrating a cross section XIIIA-XIIIA in FIG. 1.
Figure 13B:
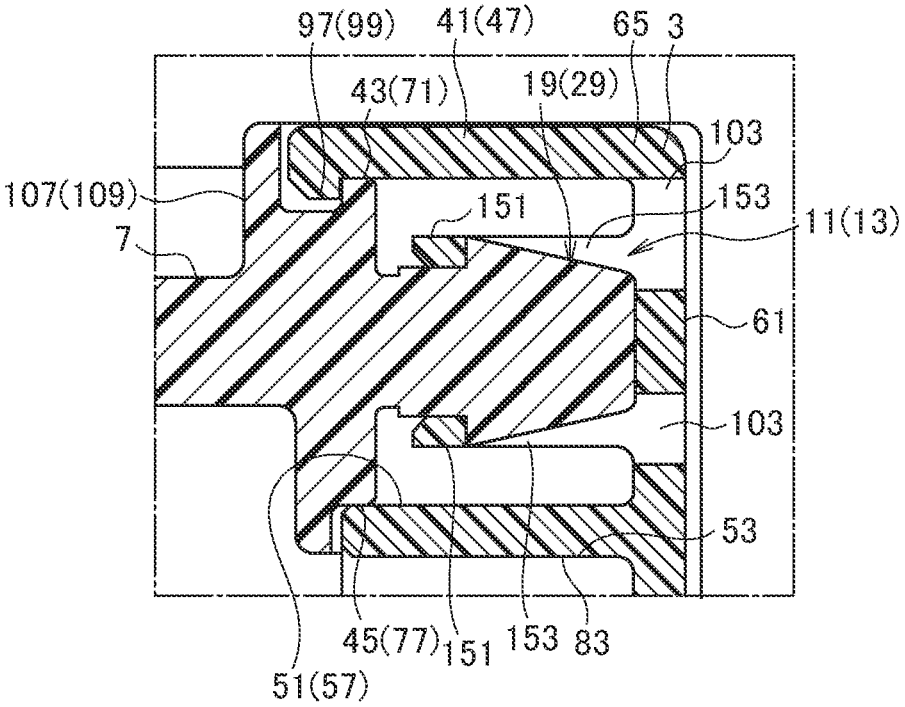
FIG. 13B is an enlarged view of the XIIIB portion in FIG. 13A.

As illustrated in FIGS. 13A, 13B and the like, the first body 7 deploys to a predetermined direction from a first boundary 27, which is a boundary with the connection section 5 so as to protrude from the connection section 5. The first boundary 27 is formed by a part of an outer edge of the connection section 5. Further, the first boundary 27 extends in a direction (X direction) that intersects (may be intersected orthogonally, for example) with respect to a deployed direction (Y direction and Z direction) of one first abutting part 21 of the pair of first abutting parts 21.

The first locking part 19 and the one first abutting part 21 are arranged on an end part of the first body 7 on a side opposite to the first boundary 27. That is, in the Y direction, the first boundary 27 is positioned on one side, and the first locking part 19 and the first abutting parts 21 are positioned on the other side.

As illustrated in FIGS. 5 and 6, the second body 9 is provided with a second locking part 29 and a pair of second abutting parts 31. The second locked portion 13 of the locking member 3 is configured to be locked to the second locking part 29. Another part (first-abutted-portion second part) 33 on each of the pair of first abutted portions 15 of the locking member 3 is configured to be brought into surface contact with and to abut on each of the pair of second abutting parts 31. The pair of second abutting parts 31 are formed to be a pair of planar second abutting surfaces 35 that are parallel to each other, for example.

As illustrated in FIGS. 13A, 13B and the like, the second body 9 deploys in a same direction as the first body 7 from a second boundary 37, which is a boundary with the connection section 5 so as to protrude from the connection section 5. The second boundary 37 is formed by a part of an outer edge of the connection section 5. Further, the second boundary 37 extends in a direction (X direction) that intersects (may be intersected orthogonally, for example) with respect to a deployed direction (Y direction and Z direction) of one second abutting part 31 of the pair of second abutting parts.

More specifically, the first boundary 27 and the second boundary 37 are parallel to each other and extend in the same direction, and the first abutting parts 21 and the second abutting parts 31 are developed in parallel to each other. The first boundary 27 is arranged at one end of the first body 7 in the Y direction and the second boundary 37 is arranged at one end of the second body 9 in the Y direction. The second locking part 29 and the second abutting parts 31 are arranged at an end of the second body 9 on a side opposite to the second boundary 37 in the Y direction, as in the case of the first body 7.

The fusible link unit 1 has a foldable structure configured so as the first body 7 to overlap the second body 9. Thus, the fusible link unit 1 may be called a fusible link unit having a foldable structure.

Here, a state in which the first locked portion 11 is locked to the first locking part 19 and the second locked portion 13 is locked to the second locking part 29 is defined as a locking-member installation-completion state. In the locking-member installation-completion state, the first-abutted-portion first part 23 abuts on the first abutting part 21, and the first-abutted-portion second part 33 abuts on the second abutting part 31.

A fusible link unit body 39 is formed of the connection section 5, the first body 7, and the second body 9. The locking member 3 is separated from the fusible link unit body 39. That is, in the locking-member installation-completion state, the locking member 3 is integrated with the fusible link unit body 39. On the other hand, when the locking member 3 is not installed in the fusible link unit body 39, the locking member 3 is separated from the fusible link unit body 39.

The locking member 3 and the fusible link unit body 39 may not be separated from each other. For example, the second body 9 and the locking member 3 may be form so as the second body 9 and the locking member 3 to be always connected to each other, and the locking member 3 may rotate relative to the second body 9 at the boundary between the locking member 3 and the second body 9. The locking member 3 may be placed in a non-installation state or a locking-member installation-completion state by the above described rotation of the locking member 3.

The locking member 3 is provided with a pair of second abutted portions 41, the first body 7 is provided with a third abutting part 43, and the second body 9 is provided with a fourth abutting part 45. In the locking-member installation-completion state, one second abutted portion (second abutted portion first part) 47 of the pair of second abutted portions 41 abuts on the third abutting part 43. Further, in the locking-member installation-completion state, the other second abutted portion (second abutted portion second part) 49 of the pair of second abutted portions 41 abuts on the fourth abutting part 45.

The first body 7 is prevented from separating from the second body 9 in the locking-member installation-completion state. In the locking-member installation-completion state, the positional relationship between the first body 7 to the second body 9 is maintained by a configuration the first locked portion 11 being locked to the first locking part 19 and the second locked portion 13 being locked to the second locking part 29.

Furthermore, the folded state at the first boundary 27 and the second boundary 37 is maintained and the foldable structure is maintained by a configuration the second abutted portion first part 47 being abutted on the third abutting part 43 and the second abutted portion second part 49 being abutted on the fourth abutting part 45.

The locking member 3 is further provided with a pair of third abutted portions 51, the first body 7 is provided with a fifth abutting part 53, and the second body 9 is provided with a sixth abutting part 55. In the locking-member installation-completion state, one third abutted portion (the third abutted portion first part) 57 of the pair of third abutted portions 51 abuts on the fifth abutting part 53. Further, in the locking-member installation-completion state, the other third abutted portion (third abutted portion second part) 59 of the pair of third abutted portions 51 abuts on the sixth abutting part 55.

The first body 7 is prevented from approaching the second body 9 in the locking-member installation-completion state. The locking-member installation-completion state is maintained by a configuration the first locked portion 11 being locked to the first locking part 19 and the second locked portion 13 being locked to the second locking part 29.

Furthermore, the folded state at the first boundary 27 and the second boundary 37 is maintained and the foldable structure is maintained by a configuration the third abutted portion first part 57 being abutted on the fifth abutting part 53 and the third abutted portion second part 59 being abutted on the sixth abutting part 55.

Here, the fusible link unit 1 will be further described.

Figure 11A:
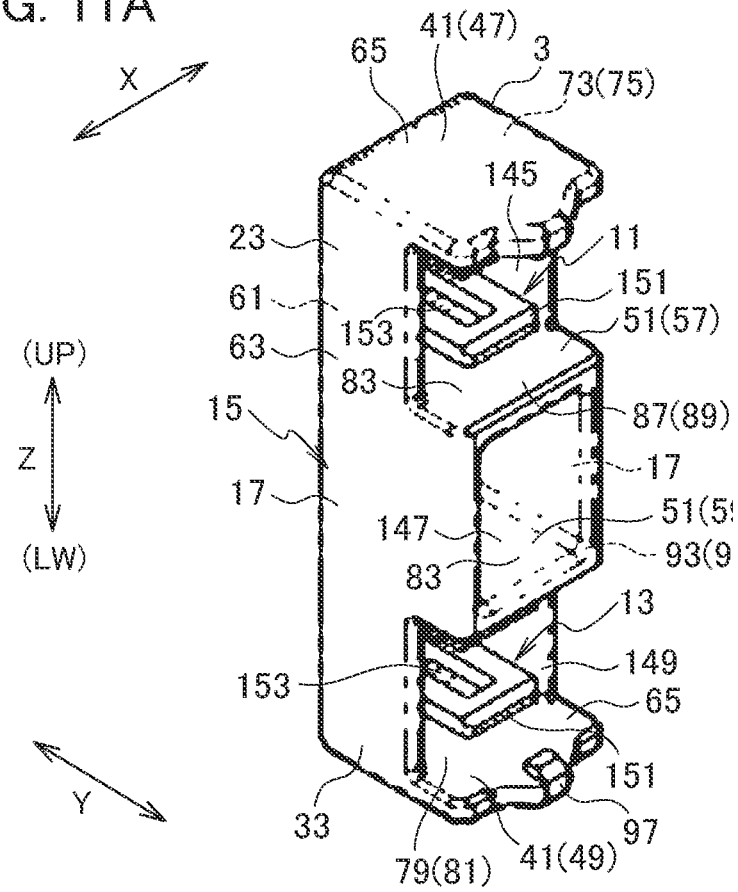
FIG. 11A is a perspective view of the locking member of the fusible link unit according to one or more embodiments.
Figure 11B:
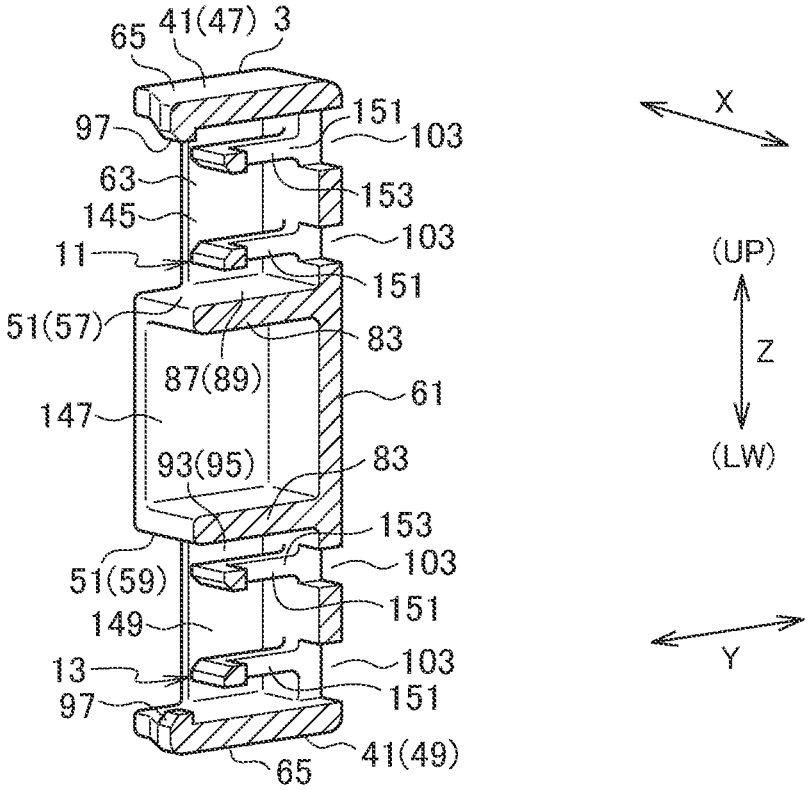
FIG. 11B is a perspective view of the locking member of the fusible link unit according to one or more embodiments, and is a partially cross sectional view.
Figure 12A:
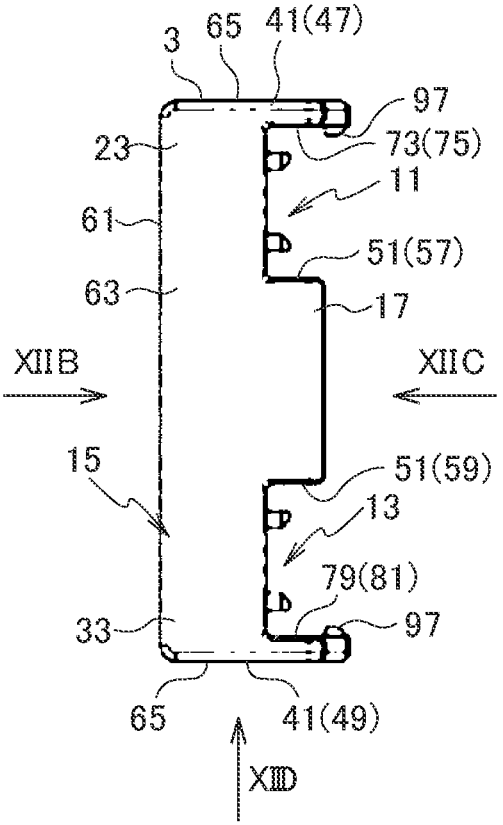
FIG. 12A is a front view of the locking member of the fusible link unit according to one or more embodiments.
Figure 12B:
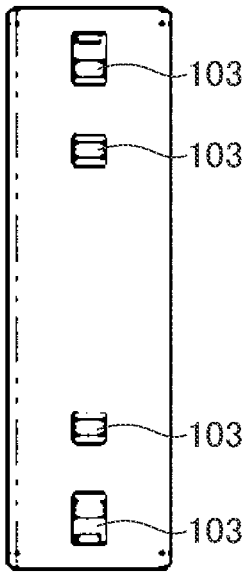
FIG. 12B is a view taken along an arrow XIIB in FIG. 12A.
Figure 12C:
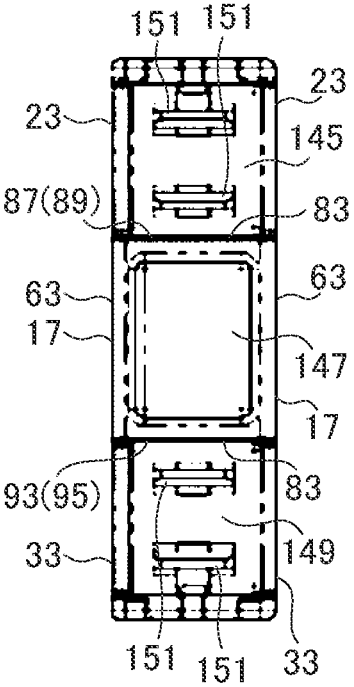
FIG. 12C is a view taken along an arrow XIIC in FIG. 12A.
Figure 12D:
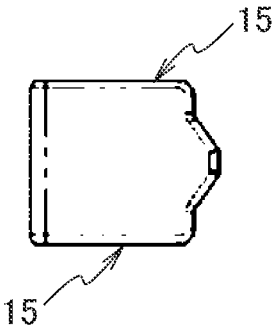
FIG. 12D is a view taken along an arrow XIID in FIG. 12A.

As described above, the locking member 3 is provided with a first locked portion 11 and a second locked portion 13. As illustrated in FIGS. 11A, 11B and the like, the locking member 3 is formed in a rectangular open-top-box structure having a bottom wall 61, a pair of first sidewalls 63, and a pair of second sidewalls 65.

The bottom wall 61 is formed in a rectangular flat plate shape, and has a thickness direction in the Y direction. Each of the first sidewalls 63 is also formed in a rectangular flat plate shape, and has a thickness direction in the X direction.

Each of the first sidewalls 63 rises in the Y direction from a pair of sides of the bottom wall 61. Each of the second sidewalls 65 is also formed in a rectangular flat plate shape, and has a thickness direction in the Z direction. Each of the second sidewalls 65 rises in the same direction as the first sidewall 63 from each of the other pair of sides of the bottom wall 61. The connection section 5 is formed, for example, in a rectangular flat plate shape.

Each of a pair of first abutting surfaces 25 of the pair of first abutting parts 21 is configured to abut on a part (the first-abutted-portion first part) 23 of an outer surface of the pair of first sidewalls 63.

The first boundary 27 extends in a direction (X direction) orthogonal to the deployed direction of the first abutting surface 25.

Each of a pair of second abutting surfaces 35 of the pair of second abutting parts 31 is configured to abut on a part (the first abutted portion second part) 33 of the outer surface of the pair of first sidewalls 63.

The second boundary 37 extends in a direction orthogonal to the deployed direction of the second abutting surface 35 and extends in parallel with the first boundary 27.

The first body 7 is provided with a rectangular parallelepiped recess 67. The first abutting surface 25 is formed of a part of a wall surface of a rectangular parallelepiped recess 67. The second body 9 is also provided with a rectangular parallelepiped recess 69 in the same manner as the first body 7. The second abutting surface 35 is also formed of a part of the wall surface of the rectangular parallelepiped recess 69.

In the locking-member installation-completion state, one end of the locking member 3 in the Z direction (a first end; an upper end) is fitted into the rectangular parallelepiped recess 67 of the first body 7. In addition, in the locking-member installation-completion state, the other end of the locking member 3 in the Z direction (a second end; an lower end) is fitted into the rectangular parallelepiped recess 69 of the second body 9. The recesses 67 and 69 are just filled with the locking member 3. In the locking-member installation-completion state, the locking member 3 is held between the first body 7 in the X direction, and the locking member 3 is held between the second body 9 in the X direction.

The third abutting part 43 of the first body 7 includes a third abutting surface 71. The third abutting surface 71 is deployed in parallel with the deployed direction of the first body 7. At least a part of an inner surface 75 of one sidewall (second sidewall first part) 73 of the pair of second sidewalls 65 of the locking member 3 is configured to abut on the third abutting surface 71.

The fourth abutting part 45 of the second body 9 includes a fourth abutting surface 77. The fourth abutting surface 77 is deployed in parallel with the deployed direction of the second body 9. At least a part of an inner surface 81 of another sidewall (second sidewall second part) 79 of the pair of second sidewalls 65 of the locking member 3 is configured to abut on the fourth abutting surface 77. The deployed direction of the second body 9 is the same as the deployed direction of the first body 7.

As illustrated in FIGS. 11A, 11B and the like, the locking member 3 is provided with a pair of intermediate wall parts 83. The pair of intermediate wall parts 83 are positioned between the pair of second sidewalls 65 in the Z direction and deploy in a direction parallel to the pair of second sidewalls 65. That is, the intermediate wall parts 83 is disposed inside the pair of second sidewalls 65 in the Z direction, and is separated from each of the pair of second sidewalls 65. The intermediate wall parts 83 is formed in a rectangular plate shape, and has a thickness direction in the Z direction. The pair of intermediate wall parts 83 are also separated from each other in the Z direction.

The fifth abutting part 53 of the first body 7 includes a fifth abutting surface 85. The fifth abutting surface 85 is deployed in parallel with the deployed direction of the first body 7. At least a part of an outer surface 89 of one intermediate wall part (intermediate wall part first part) 87 of the pair of intermediate wall parts 83 of the locking member 3 is configured to abut on the fifth abutting surface 85.

The sixth abutting part 55 of the second body 9 includes a sixth abutting surface 91. The sixth abutting surface 91 is deployed in parallel with the deployed direction of the second body 9. At least a part of an outer surface 95 of the other intermediate wall part (intermediate wall part second part) 93 of the pair of intermediate wall parts 83 of the locking member 3 is configured to abut on the sixth abutting surface 91. The deployed direction of the second body 9 is the same as the deployed direction of the first body 7.

As illustrated in FIGS. 11A, 11B and the like, each of the distal ends of the pair of second sidewalls 65 of the locking member 3 is provided with a projection 97 projecting inward. As illustrated in FIGS. 5 and 6, the first body 7 is provided with a recess 99 into which the projection 97 of one sidewall (second sidewall first part) 73 of the pair of second sidewalls 65 of the locking member 3 enters. The second body 9 is provided with a recessed part 101 into which the projection 97 of the other sidewall (second sidewall second part) 79 of the pair of second sidewalls 65 of the locking member 3 enters.

Hereinafter, a state in which the locking member 3 is halfway installed to the first body 7 and to the second body 9 is defined as a locking-member halfway-installed state. In the locking-member halfway-installed state, each of the projections 97 is pushed by the thick portion of the first body 7 and the thick portion of the second body 9. As a result, each of the pair of second sidewalls 65 (each of the portions configured to be opposed to the projections 97) is configured to elastically deformed slightly outward and to protrude outward (refer to the portion indicated by reference numeral 100 in FIG. 14B).

On the other hand, in the locking-member installation-completion state, each of the projection 97 enters the recess 99 of the first body 7 and the recess 101 of the second body 9, and each of the pair of second sidewalls 65 is restored. As illustrated in FIGS. 13A and 13B, in the locking-member installation-completion state, the outer surface of the second sidewall 65 of the locking member 3 is flat.

The locking member 3 is configured to be locked to each of the bodies 7 and 9 by the projection 97 entering the recessed parts 99 and 101.

Figure 14A:
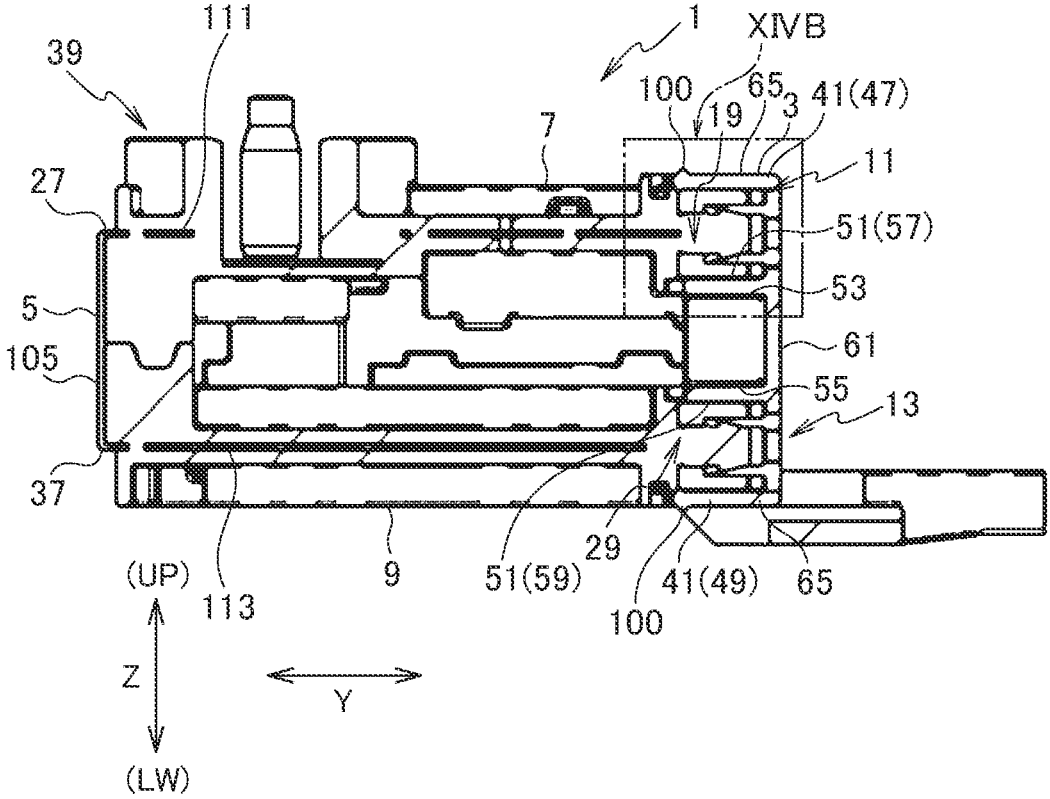
FIG. 14A is a view illustrating a cross section XIVA-XIVA in FIG. 1.
Figure 14B:
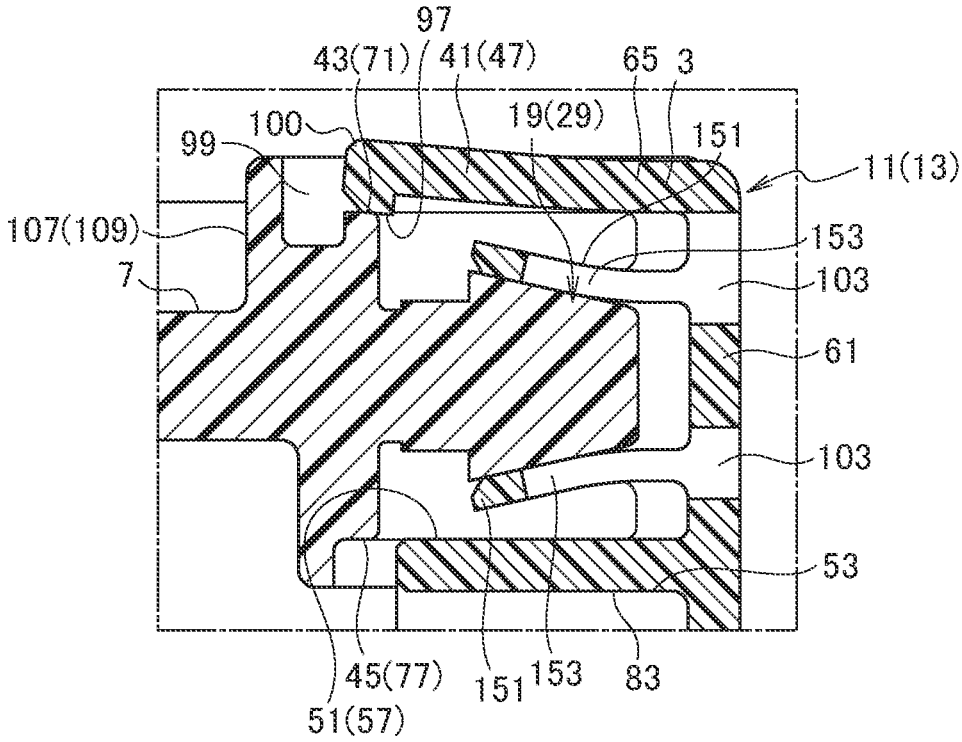
FIG. 14B is an enlarged view of the XIVB portion of FIG. 14A, in which the locking member is halfway installed to a first body.

Here, the portion indicated by reference numeral 100 in FIGS. 14A and 14B may be understood as an installation detection part (lock member installation detection part) provided in the locking member 3. The installation detection part is configured to detect whether the installation of the locking member 3 to each of the bodies 7, 9 is in a process of being installed or whether the installation of the locking member 3 to each of the bodies 7, 9 is completed.

More specifically, the installation detection part is formed of a part of an outer surface of each of the sidewalls of the pair of second sidewalls 65 of the locking member 3. When the installation of the locking member 3 to each of the bodies 7, 9 is in a halfway-installed state (in a process of being installed), a first installation detection part formed of a part of an outer surface of one sidewall (a sidewall on the first body 7 side) 65 of the locking member 3 projects outward relative to another part of the outer surface of one sidewall 65 of the locking member 3. When the installation on each of the bodies 7, 9 of the locking member 3 is in a halfway-installed state, a second installation detection part formed of a part of an outer surface of the other sidewall (the sidewall on the second body 9 side) 65 of the locking member 3 projects outward relative to another part of the outer surface of the other sidewall 65 of the locking member 3.

On the other hand, when installation of the locking member 3 to each of the bodies 7, 9 is completed, the sidewall (the sidewall on the first body 7 side) 65 is restored, and the first installation detection part of the locking member 3 does not project outward. One outer surface on the first body 7 side of the locking member 3 provided with the first installation detection part is flat. Further, when the locking member 3 is installed on each of the bodies 7, 9, the sidewall (the sidewall on the second body 9 side) 65 is restored, and the second installation detection part of the locking member 3 does not project outward. One outer surface on the second body 9 side of the locking member 3 provided with the second installation detection part is flat.

In the fusible link unit 1, the first locked portion 11 and the second locked portion 13 of the locking member 3 are provided on the bottom wall 61 of the locking member 3. The first locked portion 11 and the second locked portion 13 of the locking member 3 are positioned inside between the pair of first sidewalls 63 and between the pair of second sidewalls 65. Further, as illustrated in FIG. 11A, 11B and the like, the bottom wall 61 of the locking member 3 has a through hole 103 formed to release a state in which the locked portions 11 and 13 are locked to the locking parts 19 and 29.

The rising height of the pair of second sidewalls 65 of the locking member 3 from the bottom wall 61 is higher than the rising height of the pair of first sidewalls 63 from the bottom wall 61. When the locking member 3 is installed on the first body 7 and the second body 9, each of the pair of second sidewalls 65 is engaged with the first body 7 and the second body 9 before the pair of first sidewalls 63.

That is, when the locking member 3 is installed on each of the bodies 7 and 9, the second sidewall 65 positions the locking member 3 with respect to the first body 7 and the second body 9 in the X and Z directions. When the locking member 3 is installed on each of the bodies 7 and 9, the locking member 3 is guided by the second sidewall 65.

Here, the fusible link unit 1 will be described in more detail.

The fusible link unit 1 includes a bus bar 105, a first resin portion (first housing) 107, and a second resin portion (second housing) 109. The bus bar 105 is made of a conductive material such as metal. The resin portions 107 and 109 are made of an insulating material such as synthetic resin.

Figure 9:
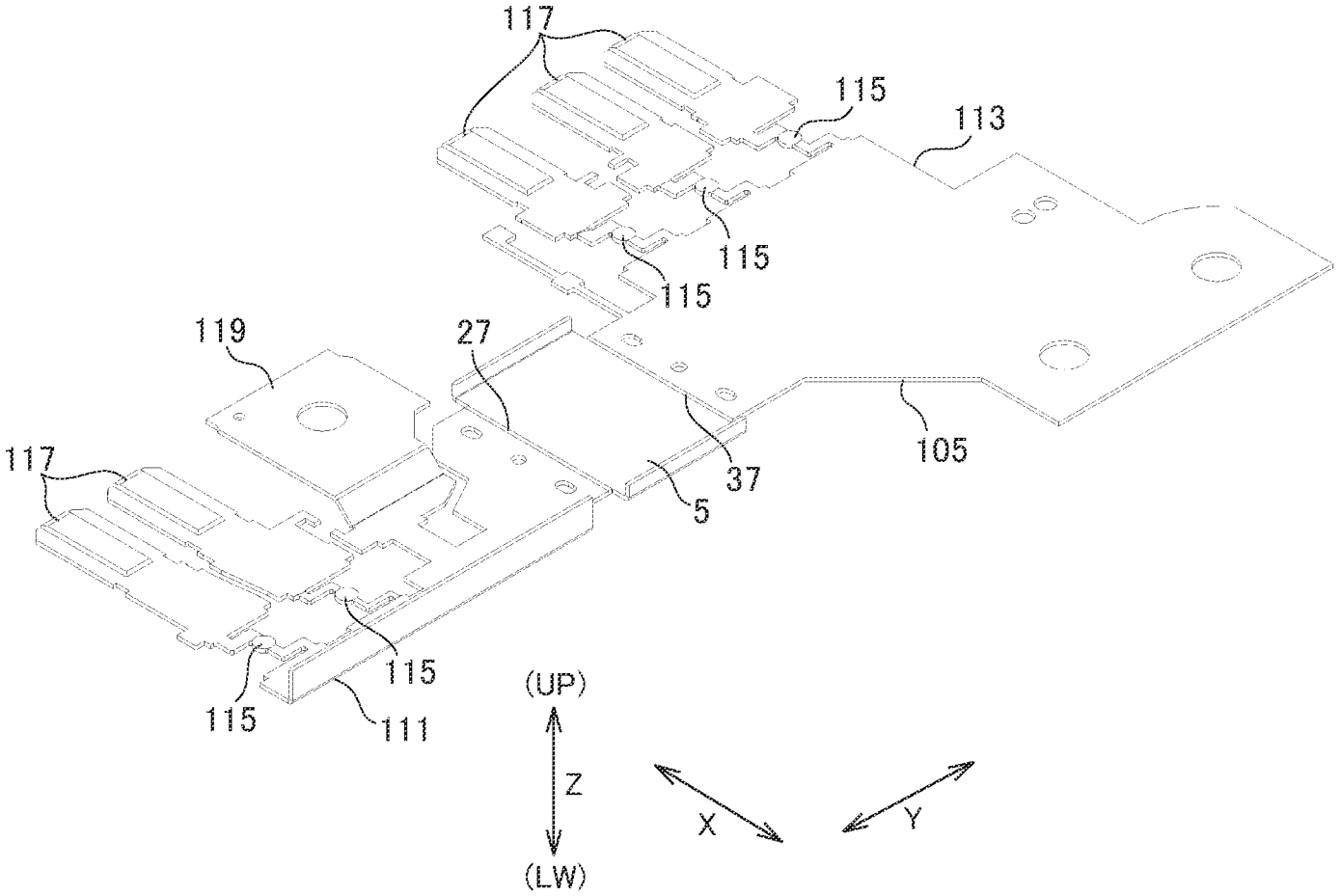
FIG. 9 is a perspective view of a bus bar of the fusible link unit according to one or more embodiments, illustrating the bus bar before being folded.
Figure 10:
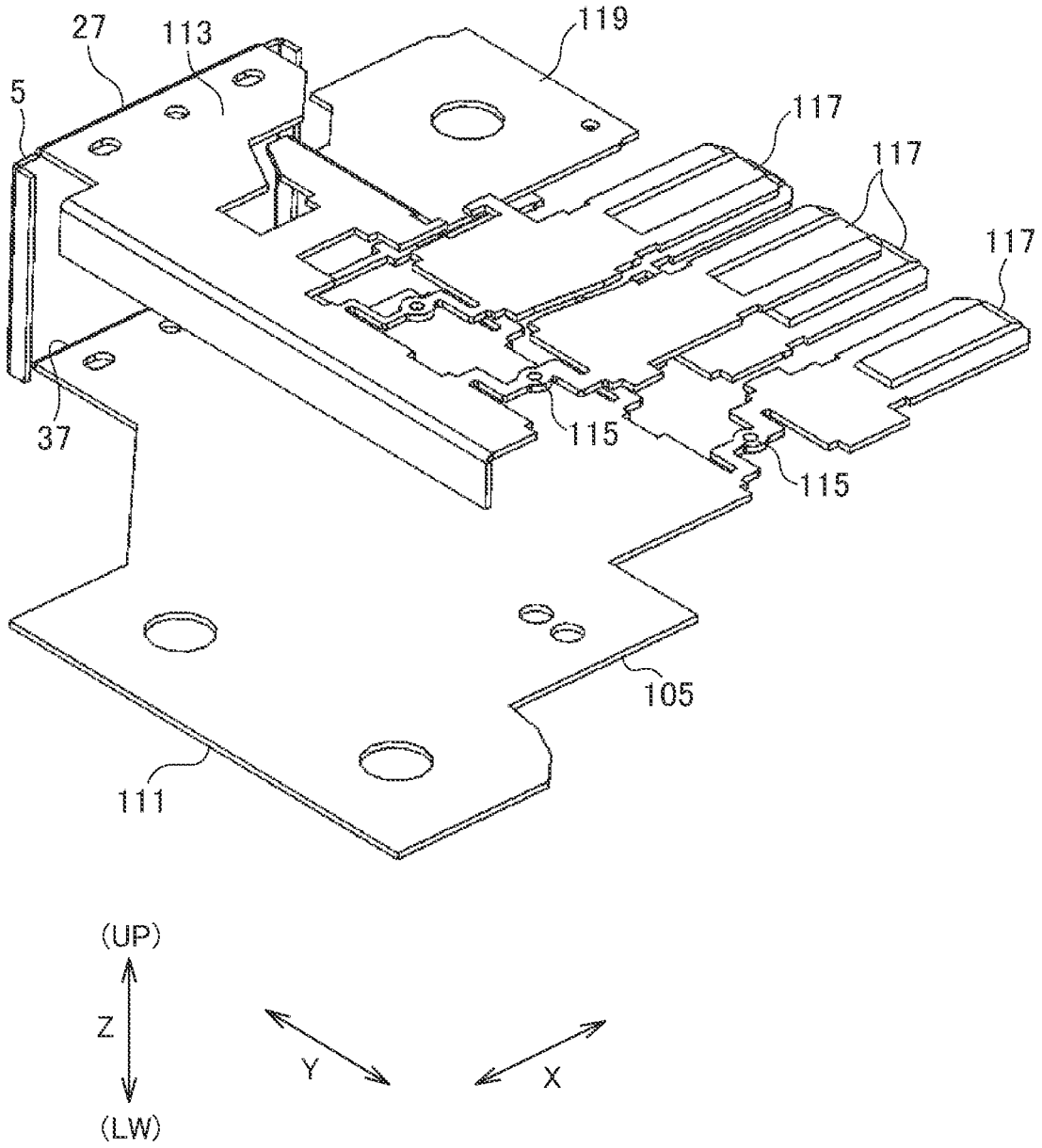
FIG. 10 is a perspective view of the bus bar of the fusible link unit according to one or more embodiments.

As illustrated in FIGS. 9, 10 and the like, the bus bar 105 has a flat strip portion (connection section; first section) 5, a flat second section (first fuse circuit plate section) 111, and a flat third section (second fuse circuit plate section) 113.

The boundary between the first section 5 and the second section 111 is the first boundary 27. The boundary between the first section 5 and the third section 113 is the second boundary 37. In FIG. 10, the thickness direction of the first section 5 is in the Y direction, and the thickness direction of the second section 111 and the thickness direction of the third section 113 are in the Z direction.

The first resin portion 107 is integrally molded at the second section 111 of the bus bar 105 by insert molding, for example. The first resin portion 107 covers at least a part of the second section 111 of the bus bar 105. The second resin portion 109 is integrally molded at the third section 113 of the bus bar 105 by insert molding, for example. The second resin portion 109 covers at least a part of the third section 113 of the bus bar 105.

The first body 7 comprises the first resin portion 107 and the second section 111 of the bus bar 105. The second body 9 comprises the second resin portion 109 and the third section 113 of the bus bar 105. The first boundary 27 and the second boundary 37 are not covered with the resin portions 107 and 109 and are exposed.

As illustrated in FIG. 9 and the like, the second section 111 of the bus bar 105 is provided with a fusible part (fuse element) 115, a load terminal connection part 117, and a battery terminal connection part 119. The third section 113 of the bus bar 105 is provided with a fusible part 115 and a load terminal connection part 117.

Figure 7:
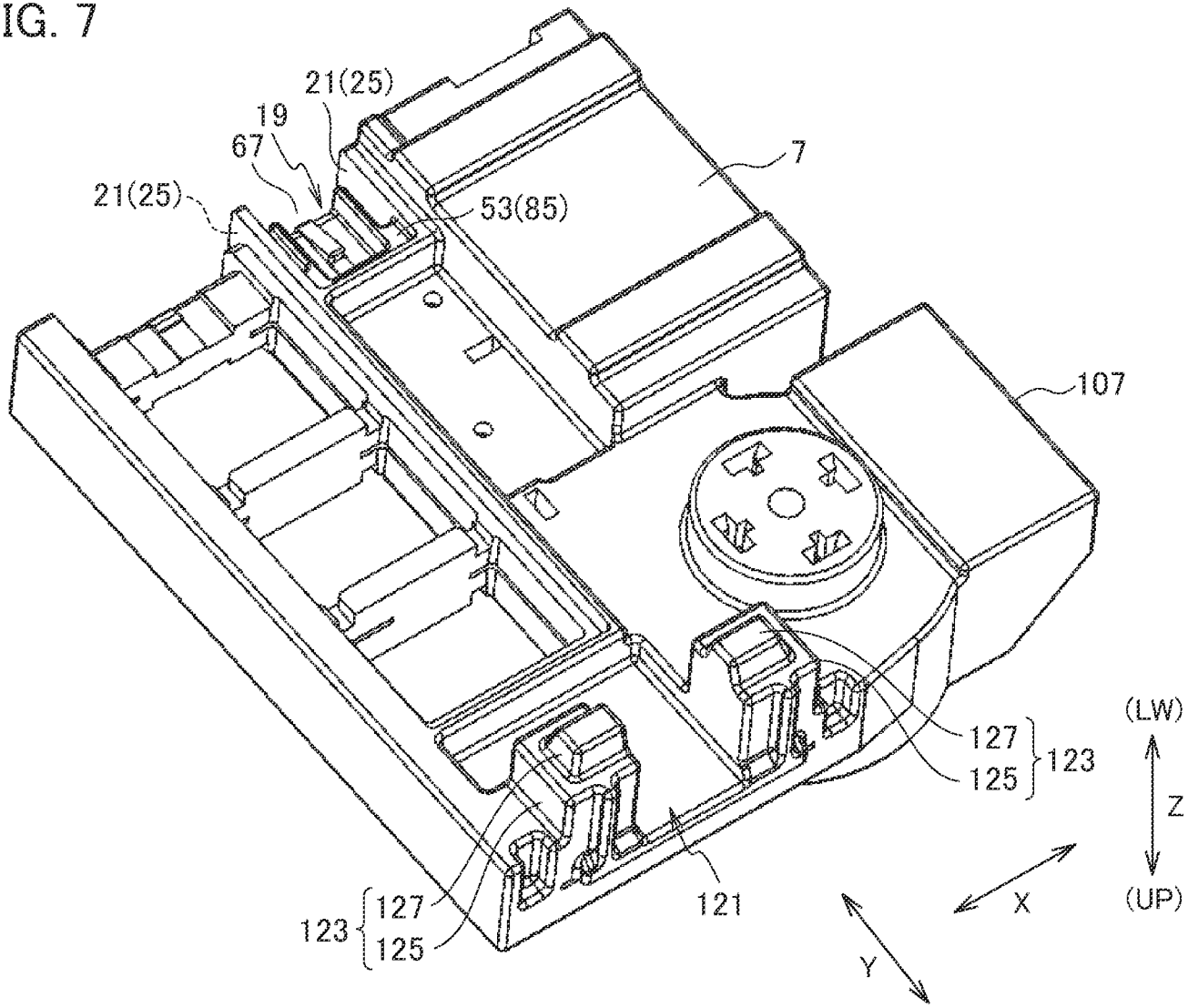
FIG. 7 is a perspective view of a first resin part of the fusible link unit according to one or more embodiments.

In addition to the first locking part 19, the first abutting part 21, the third abutting part 43, the fifth abutting part 53, and the recess 67, the first resin portion 107 is provided with a temporarily locked part 121 as illustrated in FIG. 7. The first locking part 19, the first abutting part 21, the third abutting part 43, the fifth abutting part 53 and the recess 67 are positioned on the opposite side to the first boundary 27 in the Y direction, while the temporarily locked part 121 is positioned on the first boundary 27 side in the Y direction.

The temporarily locked part 121 comprises a pair of projections 123. The pair of projections 123 are spaced apart from each other in the Y direction and projects toward the second body 9 in the Z direction. The projection 123 is formed of a rectangular parallelepiped base part 125 and a quadrangular frustum shaped tip part 127.

As illustrated in FIG. 5, the first locking part 19 is formed in the recess 67 and formed of a square columnar projection 131 projecting in the Y direction from the bottom surface 129 of the recess 67. Recesses 133 of a rectangular parallelepiped shape are formed at both ends in the Z direction of the projection 131. Further, each of the recesses 133 is provided with a protrusion 135.

A first abutting surface 25 of the first abutting part 21 is formed by a side surface of the recess 67. The third abutting surface 71 of the third abutting part 43 is formed by one side surface (side surface excluding the recess 133) of the projection 131. As illustrated in FIG. 6 and the like, the fifth abutting surface 85 of the fifth abutting part 53 is formed by the other side surface (side surface excluding the recess 133) of the projection 131.

Figure 8:
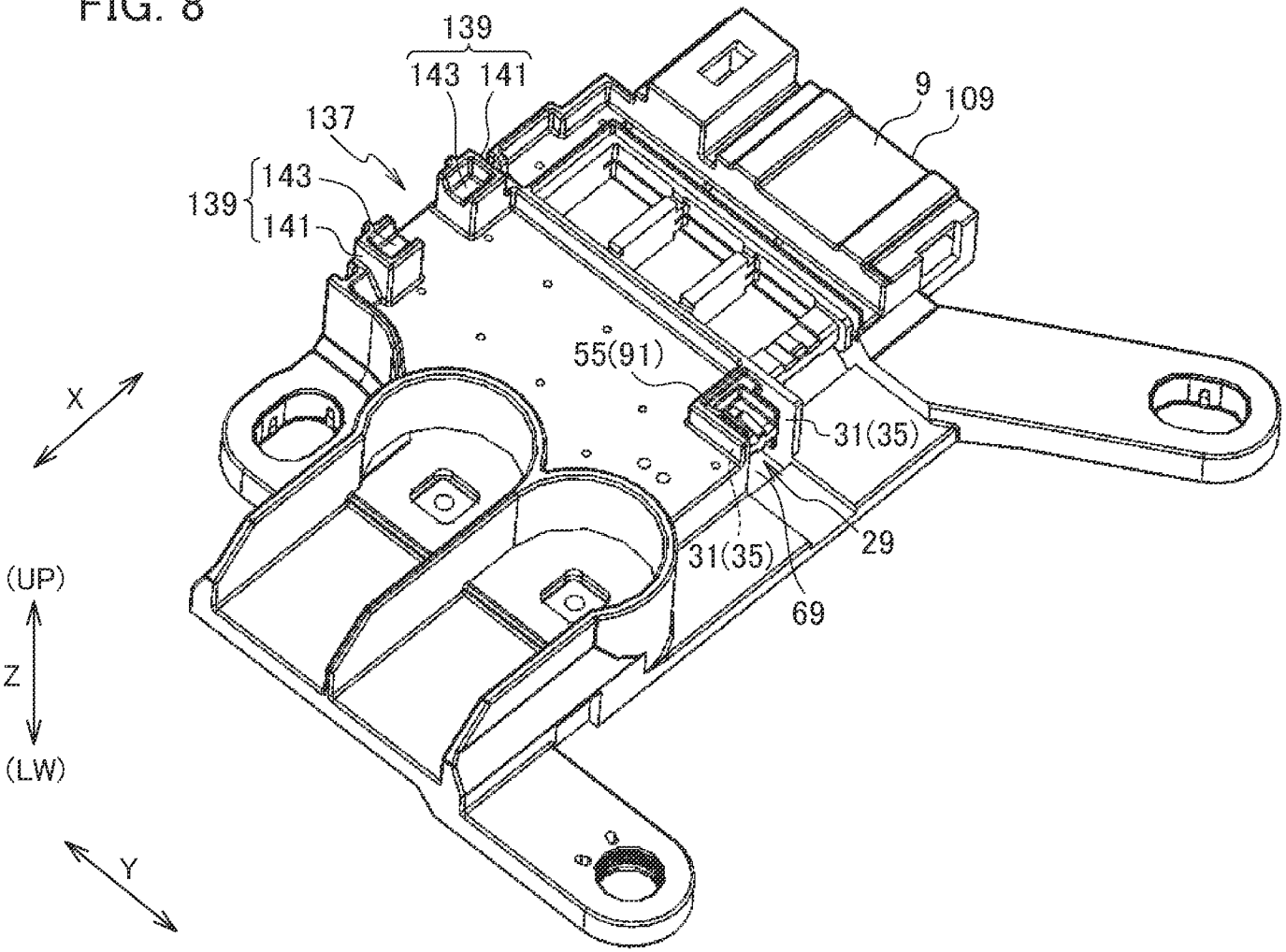
FIG. 8 is a perspective view of a second resin part of the fusible link unit according to one or more embodiments.

In addition to the second locking part 29, the second abutting part 31, the fourth abutting part 45, the sixth abutting part 55, and the recessed part 69, the second resin portion 109 is provided with a temporary locking part 137 as illustrated in FIG. 8 In the second resin portion 109, the second locking part 29, the second abutting part 31, the fourth abutting part 45, the sixth abutting part 55 and the recess 69 are positioned on the opposite side to the second boundary 37 in the Y direction, while the temporary locking part 137 is positioned on the second boundary 37 side in the Y direction.

The temporary locking part 137 comprises a pair of projections 139. The pair of projections 139 are spaced apart from each other in the Y direction and projects toward the first body 7 in the Z direction. The projection part 139 is formed of a rectangular parallelepiped body part 141 and a quadrangular frustum shaped recessed part 143. The recessed part 143 is recessed on a tip surface of the body part 141.

The second locking part 29 is configured similarly to the first locking part 19 of the first body 7. Specifically, as illustrated in FIG. 6, the second locking part 29 is formed in the recess 69 and formed of a square columnar projection 131 projecting in the Y direction from the bottom surface 129 of the recess 69, formed in the same shape as the recess 67. Recesses 133 of a rectangular parallelepiped shape are formed at both ends in the Z direction of the projection 131. Further, each of the recesses 133 is provided with a protrusion 135.

A second abutting surface 35 of the second abutting part 31 is formed by a side surface of the recess 69. The fourth abutting surface 77 of the fourth abutting part 45 is formed by one side surface (side surface excluding the recess 133) of the projection 131. The sixth abutting surface 91 of the sixth abutting part 55 is formed by the other side surface (side surface excluding the recessed 133) of the projection 131.

Figure 3:
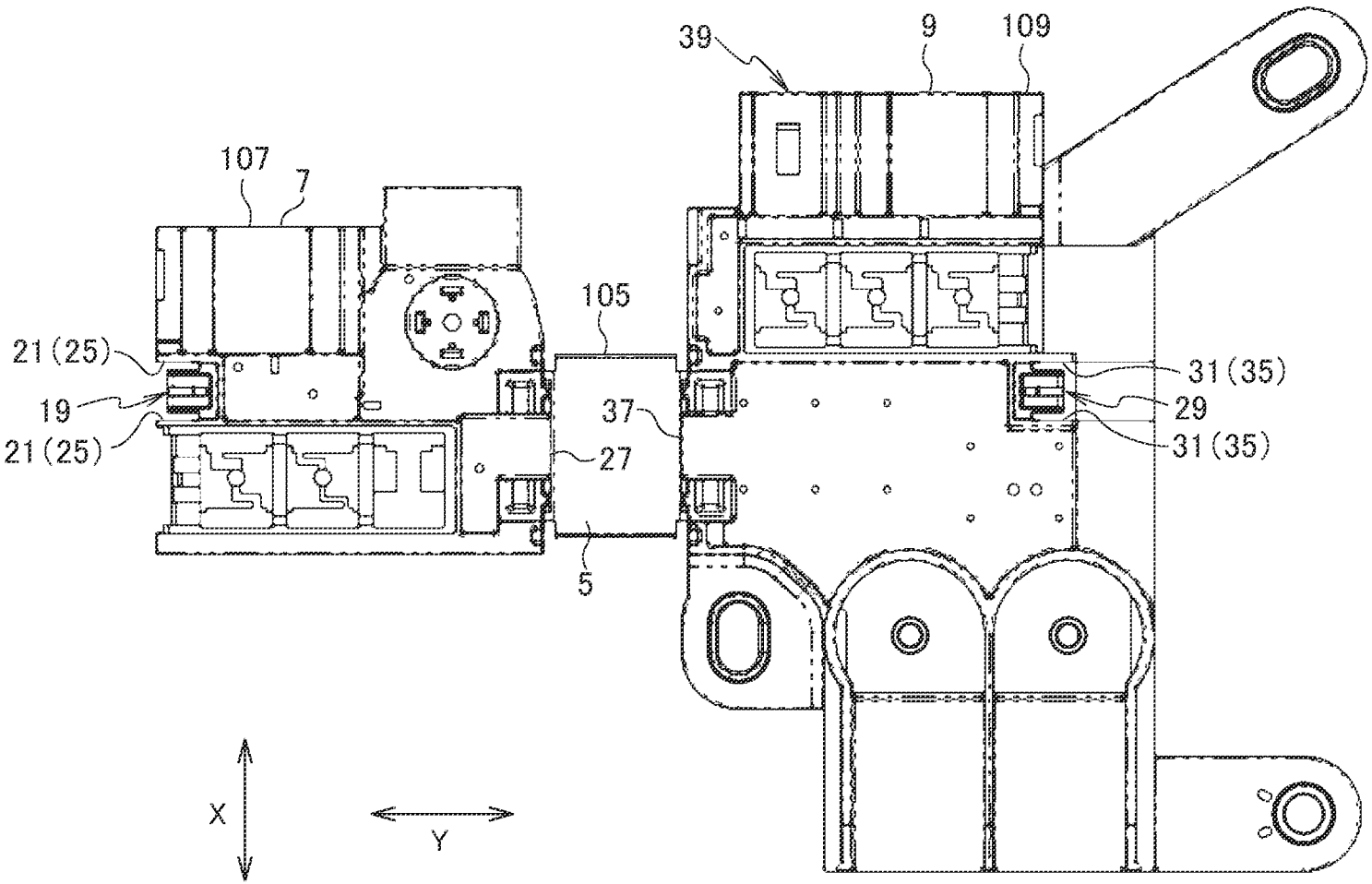
FIG. 3 is a plan view of the fusible link unit body of the fusible link unit according to one or more embodiments, illustrating the fusible link unit body before being folded.
Figure 4:
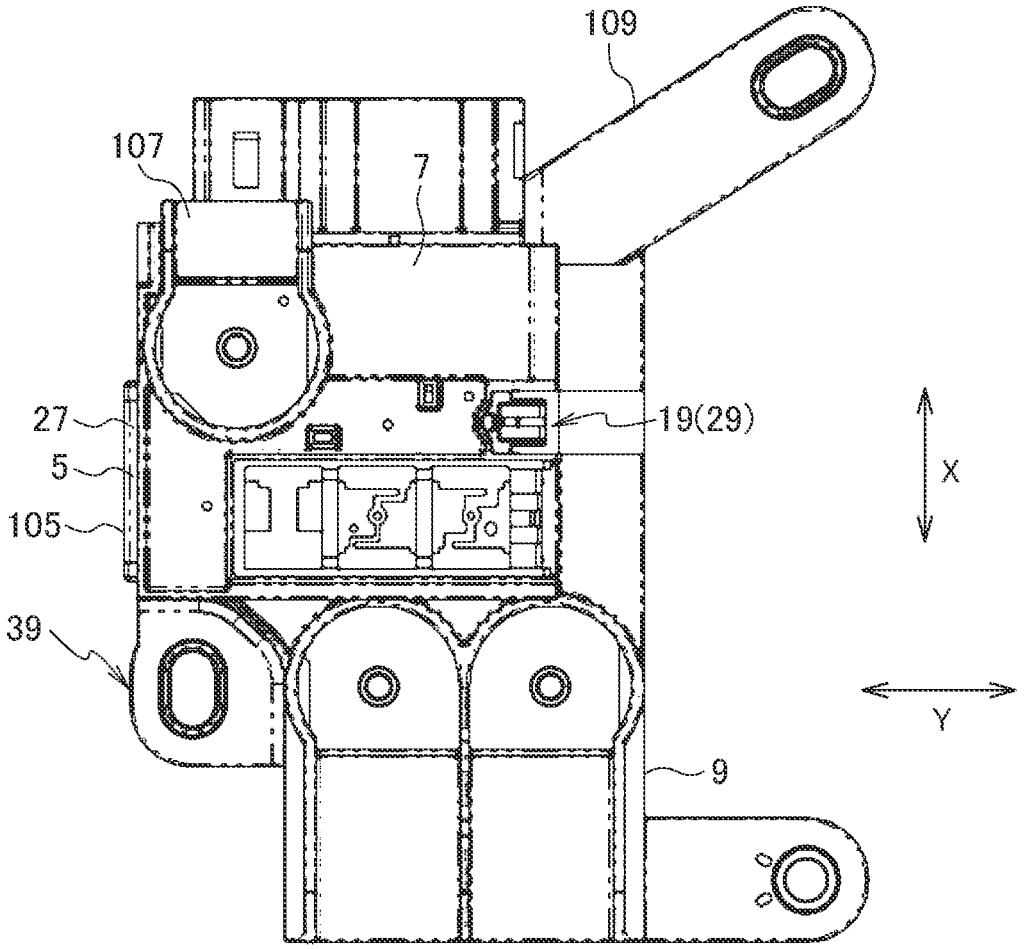
FIG. 4 is a plan view of the fusible link unit body of the fusible link unit according to one or more embodiments.

As illustrated in FIG. 3, a state in which the bus bar 105 is not bent and not folded at the first boundary 27 and the second boundary 37 is defined as a state before folding. A state in the middle of bending at the first boundary 27 and the second boundary 37 from a state before folding is defined as a state in the middle of bending. A state in which folding at the first boundary 27 and the second boundary 37 is completed from a state in the middle of bending is defined as a folding completion state (see FIG. 1, etc.).

In the state in the middle of bending, a tip end of the tip part 127 of the temporarily locked part 121 of the first body 7 abuts on the slope of the recessed part 143 of the temporary locking part 137 of the second body 9 in a sliding pair, and the first body 7 is guided to the second body 9.

In the folding completion state, the tip part 127 of the temporarily locked part 121 of the first body 7 is fitted into the recessed part 143 of the temporary locking part 137 of the second body 9 to position the first body 7 relative to the second body 9. In the folding completion state, the front end surface of the base part 125 of the first body 7 and the front end surface of the body part 141 of the second body 9 are in surface contact with each other. Further, the locking member 3 is configured to be installed on the first body 7 and the second body 9 in the folding completion state.

The locking member 3 is made of synthetic resin, and is formed in a rectangular open-top-box structure having the bottom wall 61 and the sidewalls 63 and 65 as described above. The bottom wall 61 and the sidewalls 63, 65 of the locking member 3 function as a twist prevention wall. For example, when only the plate-like sidewall 63 is used, the rigidity of the sidewall 63 may be low. However, when the bottom wall 61 and the sidewall 65 are attached to the sidewall 63, the bottom wall 61 and the sidewall 65 function as reinforcing ribs of the sidewall 63.

Thus, the rigidity of the sidewall 63 is enhanced. Similarly, the rigidity of the bottom wall 61 and the sidewall 65 is increased. Further, since the locking member 3 is formed in an open-top-box structure, the bottom wall 61 and the sidewalls 63 and 65 are in a so-called closed form, and the rigidity of the locking member 3 is further increased. Thus, the locking member 3 is hard to twist and deform against external force.

The interior of the locking member 3 is partitioned by a pair of intermediate wall parts 83. Thus, three rectangular parallelepiped spaces 145, 147 and 149 are formed inside the locking member 3. The three rectangular parallelepiped spaces 145, 147 and 149 are arranged in this order in the Z direction.

As illustrated in FIG. 11 and the like, the first locked portion 11 of the locking member 3 is formed by a projection 151 which is raised from the bottom wall 61 inside the space 145. The projection 151 is formed in a "U" letter shape. Thus, a through hole 153 is formed in the projection 151.

The second locked portion 13 of the locking member 3 is formed of a "U" letter shaped projection 151 similar to the first locked portion 11. However, the projection 151 of the second locked portion 13 rises from the bottom wall 61 inside the space 149.

In FIG. 11A, only two "U" letter shaped projections 151 are illustrated. However, in order to match the configuration of the first locked portion 11 of the first body 7 and the configuration of the second locked portion 13 of the second body 9, actually, as illustrated in FIG. 11B, four "U" letter shaped projections 151 are provided. That is, a pair of projections 151 is provided in the space 145, and a pair of projections 151 is also provided in the space 149.

As illustrated in FIG. 14B, in the locking-member half-way-installed state the projection 151 is appropriately deform elastically. As illustrated in FIG. 13B, the projection 151 is restored in the locking-member installation-completion state. Each protrusion 135 of the first body 7 enters each through hole 153 of one pair of projections 151, and each protrusion 135 of the second body 9 enters each through hole 153 of the other pair of projections 151.

In the locking-member installation-completion state, one of the pair of projections 151 sandwiches the projection 131 (the portion of the projection 131 where the recess 133 is formed) of the first locking part 19 of the first body 7 in the Z direction. Further, in the locking-member installation-completion state, the other pair of projections 151 sandwich the projection 131 (the portion of the projection 131 where the recess 133 is formed) of the second locking part 29 of the second body 9 in the Z direction.

As a result, the first locked portion 11 is locked by the first locking part 19, and the second locked portion 13 is locked by the second locking part 29.

The first abutted portion 15 of the locking member 3 is formed on the outer surface of the first sidewall 63. The second abutted portion 41 of the locking member 3 is formed on an inner surface (a surface on the space 145 side and a surface on the space 149 side) of the second sidewall 65. The third abutted portion 51 of the locking member 3 is formed on an outer surface (a surface on the space 145 side and a surface on the space 149 side) of the intermediate wall parts 83.

A through hole 103 formed on the bottom wall 61 penetrates of the bottom wall 61 in the thickness direction in accordance with a position where the four "U" letter shaped projections 151 are provided.

When removing the locking member 3 from the fusible link unit 1 in the locking-member installation-completion state, a jig (not illustrated) is inserted from the through hole 103.

This insertion deforms, for example, the "U" letter shaped projection 151.

The locked state in which the first locked portion 11 is locked to the first locking part 19 and the locked state in which the second locked portion 13 is locked to the second locking part 29 are locked states that can be released.

As described above, the amount of protrusion of the pair of second sidewalls 65 of the locking member 3 from the bottom wall 61 is larger than the amount of protrusion of the pair of first sidewalls 63 (see FIGS. 11A to 12D). Thus, the locking member 3 is positioned with respect to each of the bodies 7, 9, and the assembling property of the locking member 3 is improved.

Figure 16:
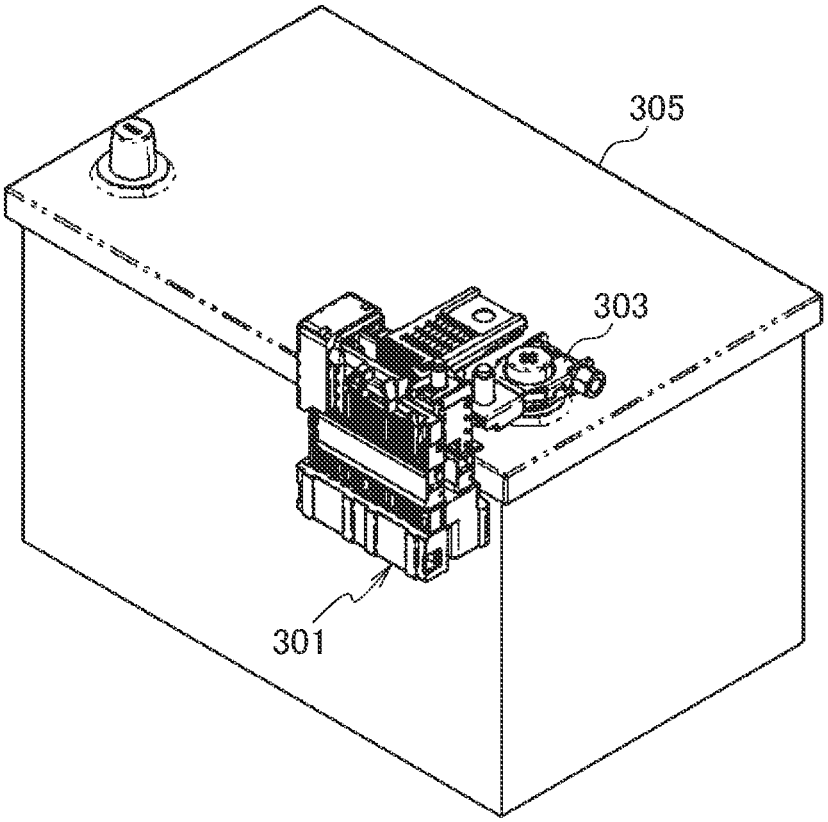
FIG. 16 is a figure illustrating a battery installation aspect of the fusible link unit according to the comparative example.

As illustrated in FIG. 16, the conventional fusible link unit 301 is installed in the battery 305 via the battery terminal 303. In contrast, the fusible link unit 1 according to the one or more embodiments does not need to be directly connected to the battery and the battery terminal. Therefore, the fusible link unit 1 can be mounted not only in an engine room and a luggage but also in an indoor space.

Next, the installation of the locking member 3 on each of the bodies 7 and 9 will be described.

Figure 2:
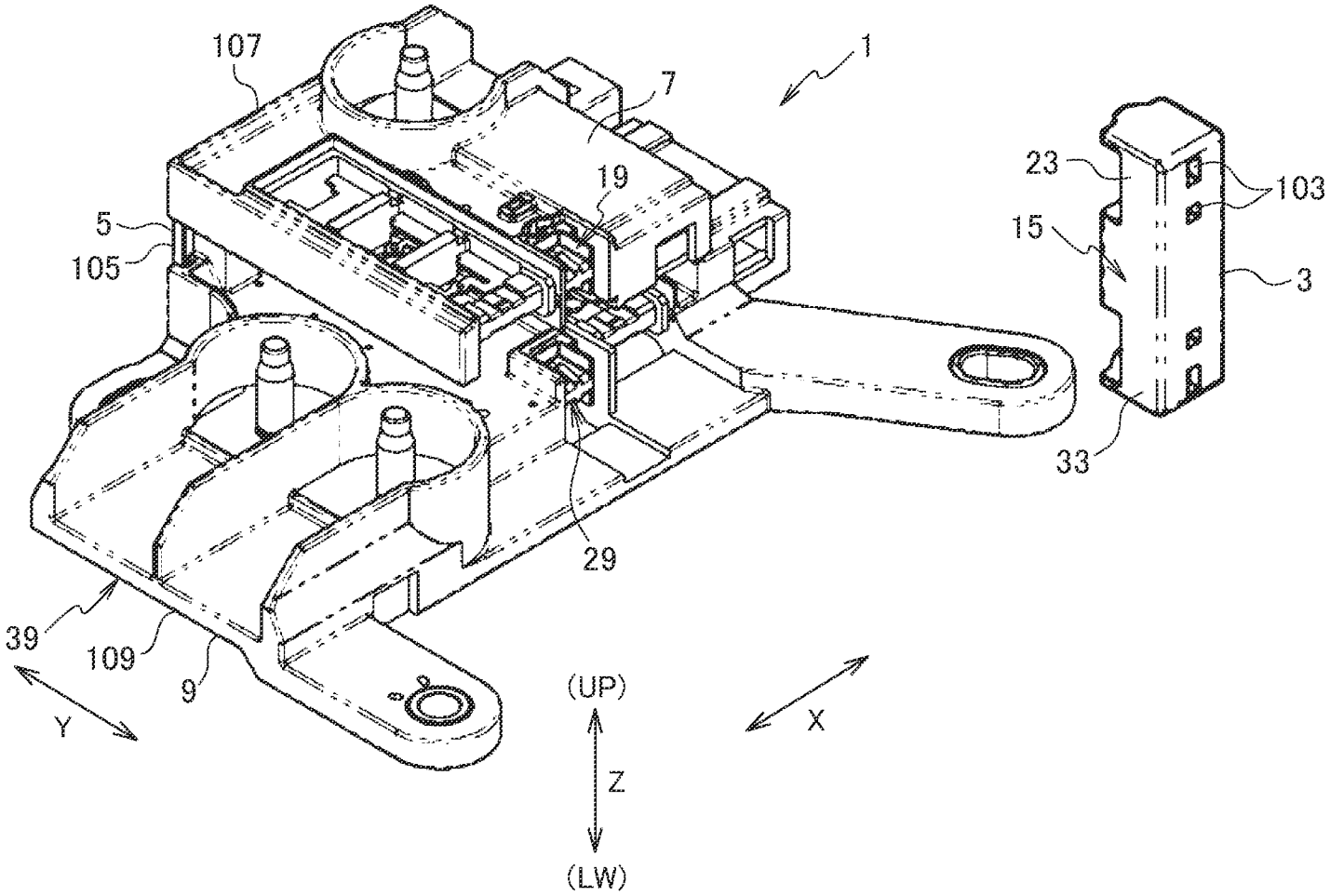
FIG. 2 is a perspective view of the fusible link unit according to one or more embodiments in which a locking member is removed from a fusible link unit body.

As illustrated in FIG. 2, the locking member 3 is appropriately moved to the fusible link unit body 39 bent at the first boundary 27 and the second boundary 37, and the locking member 3 is installed on the first body 7 and the second body 9.

In the locking-member halfway-installed state in which the locking member 3 is being halfway-installed to the first body 7 and the second body 9, the second sidewall 65 of the locking member 3 and the U-shaped projection 151 are elastically deformed as appropriate.

In a state where the locking member 3 is installed in the first body 7 and the second body 9, the second sidewall 65 of the locking member 3 and the "U" letter shape projection 151 are restored. The projection 97 of the locking member 3 enters the recess 99 of the first body 7, and the projection 97 of the locking member 3 enters the recess 101 of the second body 9. The bodies 7, 9 and the locking member 3 are integrated by, for example, entering the through hole 153 of the U-shaped projection 151 of the protrusion 135 of the locking member 3.

In the fusible link unit 1, the locking member 3 is provided with the pair of first abutted portions 15, the first body 7 is provided with the pair of first abutting parts 21, and the second body 9 is provided with the pair of second abutting parts 31. In the locking-member installation-completion state, each of the one part (the first-abutted-portion first part) 23 of the pair of first abutted portions 15 abuts on each of the pair of first abutting parts 21. In addition, in the locking-member installation-completion state, each of the other parts (the first-abutted-portion second part) 33 of the pair of first abutted portions 15 abuts on each of the pair of second abutting parts 31. Further, in the locking-member installation-completion state, a first boundary 27 serving as a boundary between the first body 7 and the connection section 5 extends in a direction (X direction) orthogonal to the deployed direction of the first abutting parts 21. In addition, in the locking-member installation-completion state, the second boundary 37 serving as the boundary between the second body 9 and the connection section 5 also extends in a direction (X direction) perpendicular to the deployed direction of the second abutting part 31.

Thus, in the fusible link unit 1 of the foldable structure, even when the force in the twisting direction is applied, the first body 7 does not easily come off detached from the second body 9.

More specifically, the first boundary 27 and the second boundary 37 extend in the X direction. The first abutted portion 15, the first abutting part 21, and the second abutting part 31 are deployed in a direction (Z Direction and Y Direction) orthogonal to the X direction. In this embodiment, the second body 9 is fixed and a torsional moment (rotational moment) about an axis extending in the Y direction is applied to the first body 7. Even if this torsional moment is applied to the first body 7, since the first abutted portion 15 abuts on the first abutting part 21 and the second abutting part 31, the torsional moment can be received. In addition, even if the second body 9 is fixed and torsional moment about the axis extending in the Z direction is applied to the first body 7, the torsional moment can be received in the same manner. Thus, even when a torsional force is applied, the first body 7 does not easily come off from the second body 9.

Figure 15A:
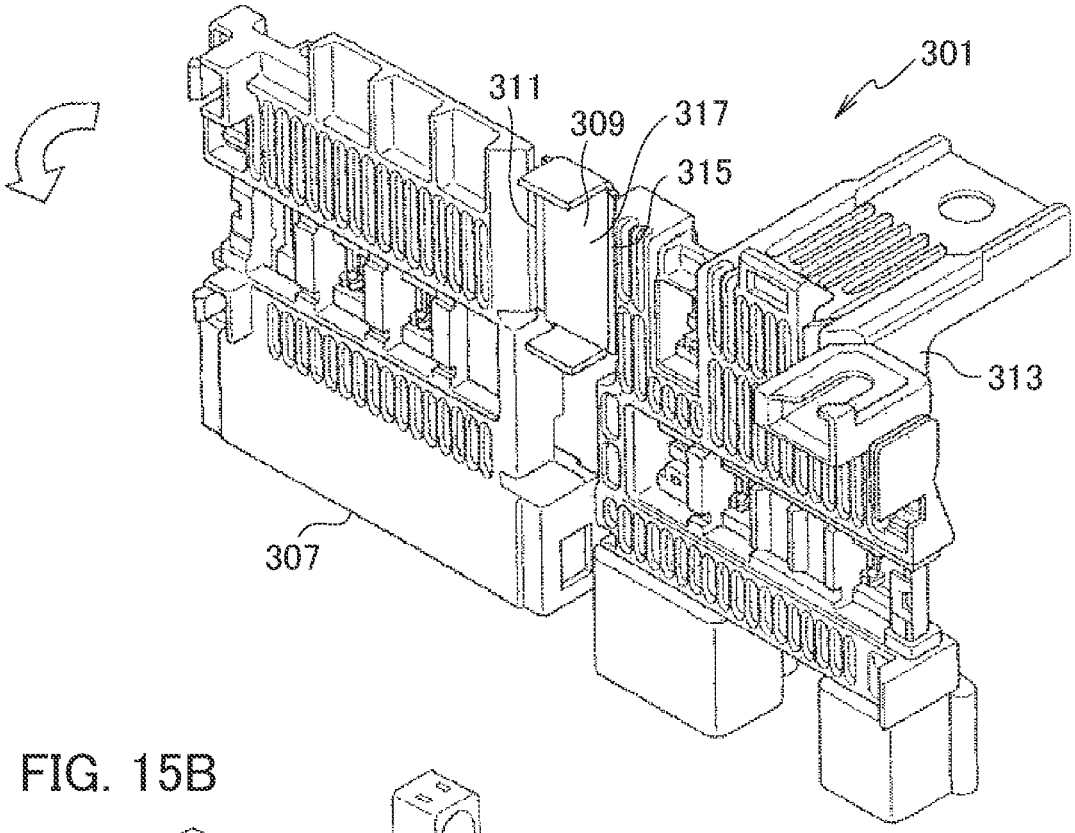
FIGS. 15A and 15B are perspective views of a fusible link unit according to a comparative example.
Figure 15B:
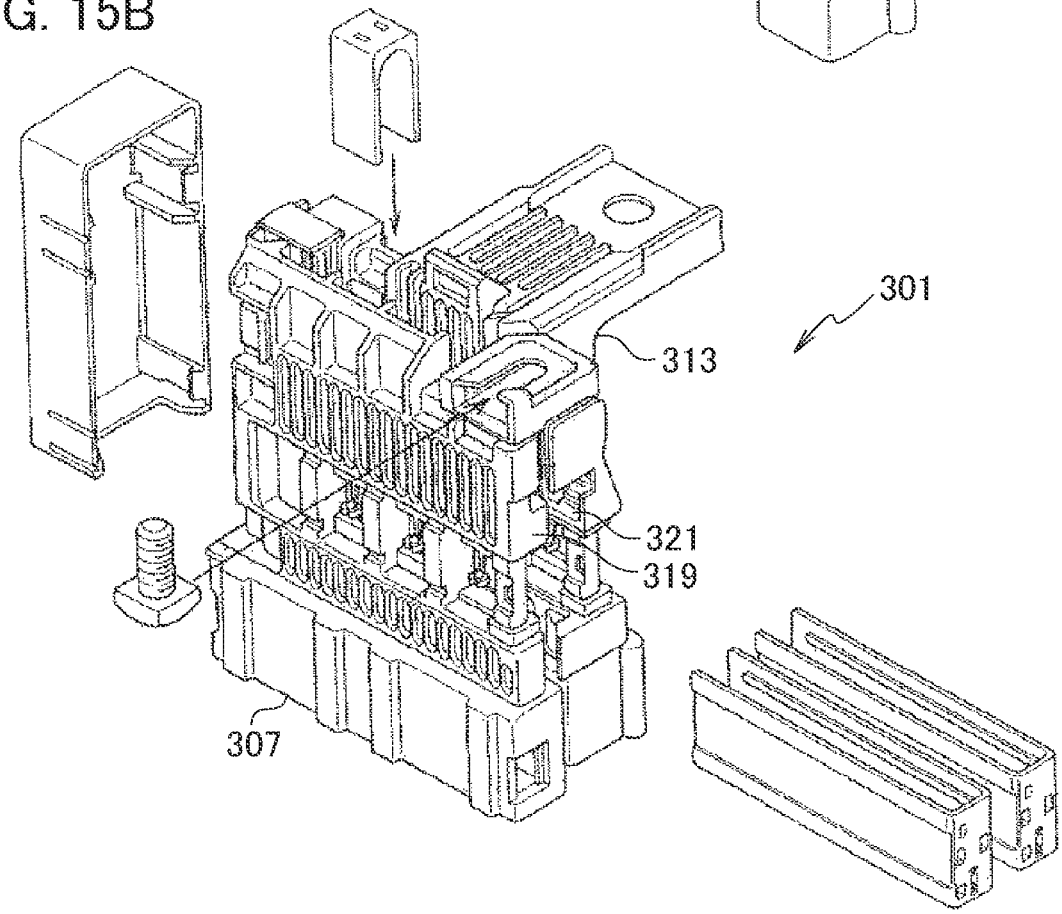

In the fusible link unit 301 according to the comparative example illustrated in FIGS. 15A and 15B, the bus bar 317 at the boundary 311 between the first body 307 and the connecting portion 309 and at the boundary 315 between the second body 313 and the connecting portion 309 is bent. After the bus bar 317 is bent, the shape holding is performed on the fusible link unit 301 (holding of the foldable structure). In the state of holding the structure, the temporarily locked portion 319 provided on the resin portion of the first body 307 is locked to the temporarily locking part 321 provided on the resin portion of the second body 313.

In the fusible link unit 301 according to the comparative example, shape holding is performed only by the resin temporary locking part (Temporary locked portion 319 of the first body 307 and the temporary locking part 321 of the second body 313). As a result, when a torsional force is applied to the first body 307 and the second body 313, there is a possibility that the temporary locking is released.

That is, when a torsional moment is applied, there is a possibility that the temporarily locked portion 319 is detached from the temporarily locking part 321.

In the fusible link unit 1, a second abutted portion first part 47 abuts on a third abutting part 43, a second abutted portion second part 49 abuts on a fourth abutting part 45, and separation of the first body 7 from the second body 9 is prevented. Thus, the first body 7 and the second body 9 can be prevented from being easily opened from the folded state of the fusible link unit 1.

More specifically, even if the second body 9 is fixed and a counterclockwise rotational moment about the first boundary 27 illustrated in FIGS. 13A and 13B is applied to the first body 7, the first body 7 does not easily rotate. Thus, the first body 7 is not separated from the second body 9. The same applies to the case where a counterclockwise rotational moment about the second boundary 37 illustrated in FIGS. 13A and 13B is applied to the first body 7.

In the fusible link unit 1, the third abutted portion first part 57 abuts on the fifth abutting part 53, the third abutted portion second part 59 abuts on the sixth abutting part 55, and the approach of the first body 7 to the second body 9 is prevented.

More specifically, even if the second body 9 is fixed and a clockwise rotational moment about the first boundary 27 illustrated in FIGS. 13A and 13B is applied to the first body 7, the first body 7 does not easily rotate. Then, the first body 7 does not approach the second body 9. The same applies to the case where a clockwise rotational moment about the second boundary 37 illustrated in FIG. 13 is applied to the first body 7.

In the fusible link unit 1, since the locking member 3 is formed in a rectangular open-top-box structure, the pair of first sidewalls 63 and the pair of second sidewalls 65 are hard to bend, and the rigidity of the locking member 3 is increased. Thus, in the fusible link unit 1 of the foldable structure, even when the force in the twisting direction is applied, the first body 7 can be more surely prevented from coming off from the second body 9.

In the fusible link unit 1, a third abutting surface 71 is provided on the first body 7, and a fourth abutting surface 77 is provided on the second body 9. In the locking-member installation-completion state, the inner surface of the second sidewall first part 73 of the locking member 3 abuts on the third abutting surface 71, and the inner surface of the second sidewall second part 79 of the locking member 3 abuts on the fourth abutting surface 77. Thus, the first body 7 and the second body 9 can be more surely prevented from being easily opened from the folded state of the fusible link unit 1.

In the fusible link unit 1, each of the projections 97 of the locking member 3 is pushed by the first body 7 and the second body 9 in the locking-member halfway-installed state, so that each of the pair of second sidewalls 65 projects outward. For a portion protruding outward from the pair of second sidewalls 65, see reference numeral 100 in FIGS. 14A and 14B. Thus, it can be easily recognized visually that the installation of the locking member 3 to the first body 7 and the second body 9 is not completed.

In the fusible link unit 1, the first body 7 is provided with the fifth abutting surface 85, and the second body 9 is provided with the sixth abutting surface 91. In the locking-member installation-completion state, the outer surface of the intermediate wall part first part 87 of the locking member 3 abuts on the fifth abutting surface 85, and the outer surface of the intermediate wall part second part 93 of the locking member 3 abuts on the sixth abutting surface 91. Thus, it is possible to more surely prevent the first body 7 and the second body 9 from being excessively closed at the folded state of the fusible link unit 1.

In the fusible link unit 1, a first locked portion 11 and a second locked portion 13 of the locking member 3 are positioned inside a pair of first sidewalls 63 and a pair of second sidewalls 65. Thus, the first locked portion 11 and the second locked portion 13 of the locking member 3 can be prevented from being damaged. That is, the first locked portion 11 and the second locked portion 13 of the locking member 3 are arranged surrounded by the pair of first sidewalls 63 and the pair of second sidewalls 65. Thus, even when the locking member 3 is erroneously hit against an obstacle or the like, the first locked portion 11 and the second locked portion 13 do not collide with the obstacle or the like. The first locked portion 11 and the second locked portion 13, which are configured to be elastically deformed with reduced rigidity, can be protected.

In the fusible link unit 1, a through hole 103 configured to release the state in which the locked portions 11 and 13 of the locking member 3 are locked to the locking parts 19 and 29 of the bodies 7 and 9 is provided on the bottom wall 61 of the locking member 3. Thus, the lowering of the rigidity of the locking member 3 can be suppressed as much as possible, the state in which the locked portions 11, 13 are locked to the locking parts 19, 29 can be released, and the locking member 3 once installed on the bodies 7, 9 can be removed from the bodies 7, 9.

In the fusible link unit 1, when the locking member 3 is installed in the first body 7 and the second body 9, each of the pair of second sidewalls 65 is engaged with each of the bodies 7, 9. The locking member 3 is guided when it is installed on each of the bodies 7, 9. Thus, the locking member 3 is guided to the respective bodies 7, 9 when the locking member 3 is installed to the first body 7 and the second body 9, and the locking member 3 is easily installed to the respective bodies 7, 9.

The relationship between the fusible link unit body 39 and the locking member 3 will be further described. From the state illustrated in FIG. 13A, the locking member (lock member) 3 is moved in the direction indicated by the arrow A1, and the locking member 3 is removed from the fusible link unit body 39. As a result, the first body 7 moves with respect to the second body 9 as indicated by the arrow A2, and the fusible link unit body 39 is expanded as illustrated in FIG. 3 or the like.

To further explain the state illustrated in FIG. 13A, even if the temporarily locked part 121 is locked to the temporarily locking part 137, the interval between the two bodies 7, 9 can be set appropriately, and a risk of unnecessary deformation of the connection section 5 is reduced.

Further, since the temporarily locked part 121 is locked to the temporarily locking part 137, a compression force is generated between the temporarily locked part 121 and the temporarily locking part 137, and a tensile force is generated in the connection section 5 as indicated by an arrow A3. Thus, the connection section 5 can be prevented from being deformed.

The fusible link unit 1 is an example of the following fusible link unit. A fusible link unit has a locking member and a fusible link unit body. The fusible link unit body is provided with a connection section, a first body, and a second body. The first body is provided with a first locking member installation part where the locking member is installed. The first body deploys in a predetermined direction from the first part of the connecting section. The second body is provided with a second locking member installation part where the locking member is installed. The second body extends from the second part of the connecting section in the same direction as the first body. In addition, in a state where the locking members are installed on the first body and the second body, the rigidity of the first body against the change of the position and the attitude of the first body with respect to the second body is enhanced.

In such a fusible link unit, the first body and the second body are provided with locking members, so that the first body has increased rigidity against changes in position and attitude with respect to the second body. Thus, even when a force is applied to the fusible link unit of the folding type structure, the first body does not easily come off from the second body.

Although the present embodiment has been described above, the present embodiment is not limited thereto, and various modifications can be made within the scope of the gist of the present embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fusible link unit comprising:

a locking member comprising a first locked portion, a second locked portion, and a pair of first abutted portions;

a connection section;

a first body comprising a first locking part configured to lock the first locked portion, and a pair of first abutting parts each of the pair of first abutting parts configured to abut a first part provided on each of the pair of first abutted portions, and extending in a predetermined direction from a first boundary, the first boundary being a boundary of the first body with the connection section and extending in a direction that intersects a deployed direction of at least one of the pair of first abutting parts;

a second body comprising a second locking part configured to lock the second locked portion, and a pair of second abutting parts each of the pair of second abutting parts configured to abut a second part provided on each of the pair of first abutted portions, and extending in the same direction as the first body from a second boundary, the second boundary being a boundary of the second body with the connection section and extending in a direction that intersects a deployed direction of at least one of the pair of second abutting parts.

2. The fusible link unit according to claim 1, wherein the locking member is provided with a pair of second abutted portions, the first body is provided with a third abutting part, the second body is provided with a fourth abutting part, and the fusible link unit is configured to prevent the first body from being separated from the second body by abutting one of the pair of second abutted portions on the third abutting part, and abutting the other of the pair of second abutted portions on the fourth abutting part.

3. The fusible link unit according to claim 1, wherein the locking member is provided with a pair of third abutted portions, the first body is provided with a fifth abutting part, the second body is provided with a sixth abutting part, and the fusible link unit is configured to prevent the first body from approaching the second body by abutting one of the pair of third abutted portions on the fifth abutting part, and abutting the other of the pair of third abutted portions on the sixth abutting part.

4. The fusible link unit according to claim 1, wherein the locking member comprises a bottom wall, a pair of first side walls, and a pair of second side walls, and is formed in a rectangular open-top-box structure, the pair of first abutting parts includes a pair of first abutting surfaces each of the first abutting surfaces being configured to abut the first part arranged on an outer surface of each of the pair of first side walls, the first boundary extends in a direction orthogonal to the deployed direction of at least one of the pair of first abutting surfaces, the pair of second abutting parts includes a pair of second abutting surfaces each of the second abutting surfaces being configured to abut the second part arranged on the outer surface of each of the pair of first side walls, and the second boundary extends in parallel with the first boundary and extends in a direction orthogonal to the deployed direction of at least one of the pair of second abutting surfaces.

5. The fusible link unit according to claim 4, wherein the first locked portion and the second locked portion of the locking member are provided on the bottom wall of the locking member and are positioned inside between the pair of the first side walls and between the pair of the second side walls.

6. The fusible link unit according to claim 4, wherein the bottom wall of the locking member is provided with a through hole configured to release the first locked portion from being locked to the first locking part or to release the second locked portion from being locked to the second locking part.

7. The fusible link unit according to claim 4, wherein the locking member is provided with an installation detection part configured to detect whether the locking member is in a process of being installed on the first body and the second body or whether the locking member has been installed on the first body and the second body.

8. The fusible link unit according to claim 7, wherein each of the pair of second side walls is provided with a projection projecting inward of the locking member, the first body is provided with a recess into which the projection on one of the pair of second side walls of the locking member enters, the second body is provided with a recess into which the projection on the other of the pair of second side walls of the locking member enters, in a state in which the locking member is in a process of being installed on the first body and the second body, each projection is pushed by the first body and the second body, whereby each of the pair of second side walls projects outward;

in a state in which the locking member has been installed on the first body and the second body, each projection enters the recess of the first body or the recess of the second body, and each of the pair of second side walls restores, the installation detection part is configured of the pair of second side walls of the locking member which projects outward in a state in which the locking member is in a process of being installed on the first body and the second body and restores in a state in which the locking member has been installed on the first body and the second body.

* * * * *